US010166775B2

(12) United States Patent
Kobayashi et al.

(10) Patent No.: US 10,166,775 B2
(45) Date of Patent: Jan. 1, 2019

(54) LIQUID DISCHARGE HEAD WITH PARTIAL FLOW PASSAGE MEMBER AND RECORDING DEVICE

(71) Applicant: KYOCERA Corporation, Kyoto-shi, Kyoto (JP)

(72) Inventors: Naoki Kobayashi, Kirishima (JP); Wataru Ikeuchi, Kirishima (JP)

(73) Assignee: KYOCERA CORPORATION, Kyoto (JP)

( * ) Notice: Subject to any disclaimer, the term of this patent is extended or adjusted under 35 U.S.C. 154(b) by 0 days.

(21) Appl. No.: 15/521,687

(22) PCT Filed: Mar. 18, 2016

(86) PCT No.: PCT/JP2016/058784
§ 371 (c)(1),
(2) Date: Apr. 25, 2017

(87) PCT Pub. No.: WO2016/152799
PCT Pub. Date: Sep. 29, 2016

(65) Prior Publication Data

US 2017/0239947 A1 Aug. 24, 2017

(30) Foreign Application Priority Data

Mar. 23, 2015 (JP) ..... 2015-059681

(51) Int. Cl.
*B41J 2/14* (2006.01)

(52) U.S. Cl.
CPC ..... *B41J 2/1433* (2013.01); *B41J 2/14* (2013.01); *B41J 2/14201* (2013.01); *B41J 2002/14306* (2013.01); *B41J 2202/12* (2013.01)

(58) Field of Classification Search
CPC ..... B41J 2/1433; B41J 2/14201
See application file for complete search history.

(56) References Cited

U.S. PATENT DOCUMENTS

2007/0291082 A1* 12/2007 Baumer ..... B41J 2/04 347/68
2013/0257991 A1* 10/2013 Panchawagh ..... B41J 2/03 347/54

FOREIGN PATENT DOCUMENTS

EP 2186642 A1 5/2010
JP 2009-056766 A 3/2009
(Continued)

OTHER PUBLICATIONS

Extended European Search Report, European Application No. 16768702.9, dated Dec. 8, 2017, 6 pgs.

*Primary Examiner* — Bradley Thies
(74) *Attorney, Agent, or Firm* — Volpe and Koenig, P.C.

(57) ABSTRACT

A liquid discharge head according to the present invention includes a flow passage member and a plurality of pressurizing sections. The flow passage member includes a plurality of discharge holes, a plurality of pressurizing chambers respectively connected to the plurality of the discharge holes, a plurality of first flow passages respectively connected to the plurality of the pressurizing chambers to supply liquid to the plurality of the pressurizing chambers, a plurality of second flow passages respectively connected to the plurality of the pressurizing chambers to collect the liquid from the plurality of the pressurizing chambers, and a plurality of third flow passages respectively connected to the pressurizing chambers to supply the liquid to the pressurizing chambers. A plurality of the pressurizing sections respectively pressurizes the plurality of the pressurizing chambers.

20 Claims, 14 Drawing Sheets

(56) References Cited

FOREIGN PATENT DOCUMENTS

| | | | |
|---|---|---|---|
| JP | 2009-143168 | A | 7/2009 |
| WO | 2007/149235 | A1 | 12/2007 |

* cited by examiner

LIQUID DISCHARGE HEAD WITH PARTIAL FLOW PASSAGE MEMBER AND RECORDING DEVICE

TECHNICAL FIELD

The present invention relates to a liquid discharge head and a recording device.

BACKGROUND ART

Conventionally, there has been proposed, as a printing head, a liquid discharge head for performing various printing tasks by discharging, for example, liquid onto a recording medium. A known liquid discharge head includes, for example, a flow passage member and a plurality of pressurizing sections. The flow passage member includes a plurality of discharge holes, a plurality of pressurizing chambers respectively connected to a plurality of the discharge holes, a plurality of first flow passages respectively connected to a plurality of the pressurizing chambers to supply liquid to a plurality of the pressurizing chambers, and a plurality of second flow passages respectively connected to a plurality of the pressurizing chambers to collect the liquid from a plurality of the pressurizing chambers. A plurality of the pressurizing sections respectively pressurizes a plurality of the pressurizing chambers.

A known liquid discharge head circulates liquid in a first flow passage, a second flow passage and a pressurizing chamber. When the liquid is not discharged, the liquid stagnates, a flow passage clogs, or another abnormality occurs (for example, see Patent Document 1).

RELATED ART DOCUMENT

Patent Document

Patent Document 1: Japanese Unexamined Patent Application Publication No. 2009-143168

SUMMARY OF THE INVENTION

A liquid discharge head according to an embodiment of the present disclosure includes a flow passage member and a plurality of pressurizing sections. The flow passage member includes a plurality of discharge holes, a plurality of pressurizing chambers respectively connected to a plurality of the discharge holes, a plurality of first flow passages respectively connected to a plurality of the pressurizing chambers to supply liquid to a plurality of the pressurizing chambers, a plurality of second flow passages respectively connected to a plurality of the pressurizing chambers to collect the liquid from a plurality of the pressurizing chambers, and a plurality of third flow passages respectively connected to the pressurizing chambers to supply the liquid to a plurality of the pressurizing chambers. A plurality of the pressurizing sections respectively pressurizes a plurality of the pressurizing chambers.

Another embodiment of the present disclosure includes a flow passage member and a plurality of pressurizing sections. The flow passage member includes a plurality of discharge holes, a plurality of pressurizing chambers respectively connected to a plurality of the discharge holes, a plurality of first flow passages respectively connected to a plurality of the pressurizing chambers, a plurality of second flow passages respectively connected to a plurality of the pressurizing chambers, a plurality of third flow passages respectively connected to a plurality of the pressurizing chambers, and a fifth flow passage connected in common to a plurality of the first flow passages and a plurality of the third flow passages. A plurality of the pressurizing sections respectively pressurizes a plurality of the pressurizing chambers. In addition, when viewed in a cross section, the pressurizing sections are disposed on the pressurizing chambers, and the third flow passages are disposed lower than the first flow passages. In addition, a flow passage resistance in the third flow passages is lower than a flow passage resistance in the first flow passages.

A recording device according to an embodiment of the present disclosure includes the liquid discharge head, a conveyor for conveying a recording medium toward the liquid discharge head, and a control section for controlling the liquid discharge head.

EMBODIMENTS FOR CARRYING OUT THE INVENTION

<First Embodiment>

Figure 1A:
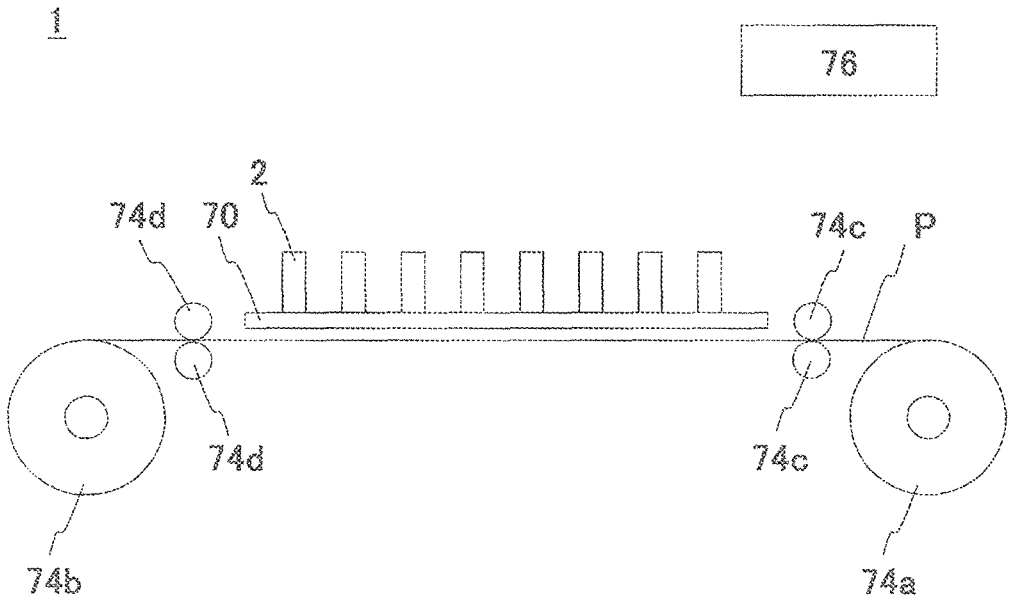
FIG. 1(*a*) is a side view schematically illustrating a recording device including a liquid discharge head, according to a first embodiment of the present invention, and FIG. 1(*b*) is a plan view schematically illustrating the recording device including the liquid discharge head, according to the first embodiment of the present invention.
Figure 1B:
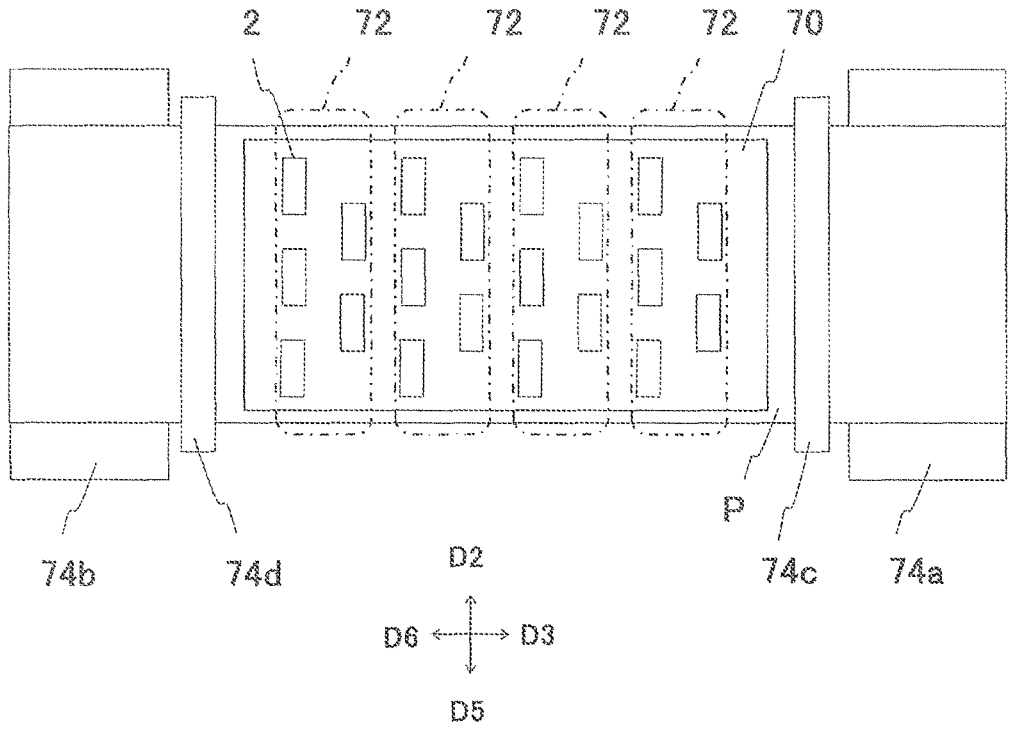

With reference to FIG. 1, a color inkjet printer 1 (hereinafter referred to as printer 1) including a liquid discharge head 2 according to a first embodiment of the present invention will now be described herein.

The printer 1 conveys a recording medium P from a conveying roller 74*a* to a conveying roller 74*b* to move the recording medium P relative to the liquid discharge head 2. A control section 76 controls the liquid discharge head 2 based on data such as an image and a text so as to discharge liquid toward the recording medium P to project droplets onto the recording medium P to perform printing on the recording medium P.

In the first embodiment, the liquid discharge head 2 is fixed to the printer 1 so that the printer 1 operates as a so-called line printer. Another embodiment of the recording device may be a so-called serial printer.

On the printer 1, a tabular head mounting frame 70 is fixed approximately parallel to the recording medium P. On the head mounting frame 70, twenty (20) holes (not shown) are provided, and the twenty (20) liquid discharge heads 2 are respectively mounted over the holes. Five (5) liquid discharge heads 2 configure a head group 72, and printer 1 has the four head groups 72.

The liquid discharge head 2 has a thin, long shape, as shown in FIG. 1(*b*). In one head group 72, the three liquid discharge heads 2 are arranged along a direction intersecting a conveying direction of the recording medium P, while the other two liquid discharge heads 2 are each arranged between the three liquid discharge heads 2, but offset along the conveying direction. The adjoining liquid discharge heads 2 are disposed to join regions printable with the liquid discharge heads 2 in a width direction of the recording medium P, or to allow edges of the printable regions to overlap so that printing is possible in a seamless manner in the width direction of the recording medium P.

The four head groups 72 are disposed along the conveying direction of the recording medium P. The liquid discharge heads 2 are each supplied with ink from a liquid tank (not shown). The liquid discharge heads 2 belonging to the one head group 72 are supplied with ink of an identical color, thus the four head groups perform a print with inks of four colors. Colors of inks each discharged from the head groups 72 include, for example, magenta (M), yellow (Y), cyan (C), and black (K).

Moreover, a number of the liquid discharge heads 2 included in each of the head groups 72 or a number of the head groups 72 may be appropriately changed depending on a print target or a print condition. For example, in order to perform further multi-color printing, a number of the head groups 72 may be increased. In addition, by disposing a plurality of the head groups 72 for printing with an identical color to alternately perform printing in the conveying direction, a print speed, i.e. conveying speed, can be increased. In addition, by preparing and disposing a plurality of the head groups 72 for printing in an identical color in a direction intersecting with the conveying direction, a resolution in a width direction of the recording medium P may be increased.

Further, in addition to performing printing with a colored ink, liquid such as a coating agent may be printed to perform a surface treatment for the recording medium P.

The printer 1 performs printing onto the recording medium P. The recording medium P wound onto the conveying roller 74*a* passes between two conveying rollers 74*c*, and then passes under the liquid discharge heads 2 mounted on the head mounting frame 70. After that, the recording medium P passes between other two conveying rollers 74*d*, and is finally collected by the conveying roller 74*b*.

The recording medium P may be cloth, in addition to printing paper. In addition, instead of the recording medium P, the printer 1 may convey a conveying belt, and, in addition to a roll-shaped recording medium, a sheet paper, a cut piece of cloth, a wooden material, or a tile may be placed on the conveying belt. Further, the liquid discharge heads 2 may discharge liquid containing conductive particles to print a wiring pattern for an electronic device. Still further, the liquid discharge heads 2 may discharge, toward a reactor vessel, a predetermined amount of a liquid chemical agent or liquid containing a chemical agent for reaction to produce a chemical product.

In addition, the printer 1 may be attached with a position sensor, a speed sensor, and a temperature sensor so that the control section 76 controls components of the printer 1 in accordance with conditions of the components based on information sent from the sensors. In particular, if a discharging characteristic (discharge amount, discharge speed, and others) of liquid discharged by the liquid discharge heads 2 is affected by an external factor, a drive signal that causes the liquid discharge heads 2 to discharge the liquid may be changed in accordance with a temperature in the liquid discharge heads 2, a liquid temperature in the liquid tank, and a liquid pressure applied from the liquid tank to the liquid discharge heads 2.

Next, with reference to FIGS. 2 to 10, the liquid discharge head 2 according to the first embodiment will now be described herein. In addition, in FIG. 9, a conventional flow of liquid is rendered with a broken line F1, a flow of liquid in a discharge unit 15 is rendered with a solid line F2 and a flow of liquid supplied from a second individual flow passage 14 is rendered with a long broken line F3.

Moreover, drawings are shown with a first direction D1, a second direction D2, a third direction D3, a fourth direction D4, a fifth direction D5, and a sixth direction D6. The first direction D1 is a direction toward which a first common flow passage 20 and a second common flow passage 24 extend, and the fourth direction D4 is another direction toward which the first common flow passage 20 and the second common flow passage 24 extend. The second direction D2 is a direction toward which a first integrated flow passage 22 and a second integrated flow passage 26 extend, and the fifth direction D5 is another direction toward which the first integrated flow passage 22 and the second integrated flow passage 26 extend. The third direction D3 is a direction orthogonal to the direction toward which the first integrated flow passage 22 and the second integrated flow passage 26 extend, and the sixth direction D6 is another direction orthogonal to the other direction toward which the first integrated flow passage 22 and the second integrated flow passage 26 extend.

The liquid discharge head 2 is described with a first individual flow passage 12, as a first flow passage, a third individual flow passage 16, as a second flow passage, the second individual flow passage 14, as a third flow passage, the second common flow passage 24, as a fourth flow passage, and the first common flow passage 20, as a fifth flow passage.

Figure 2:
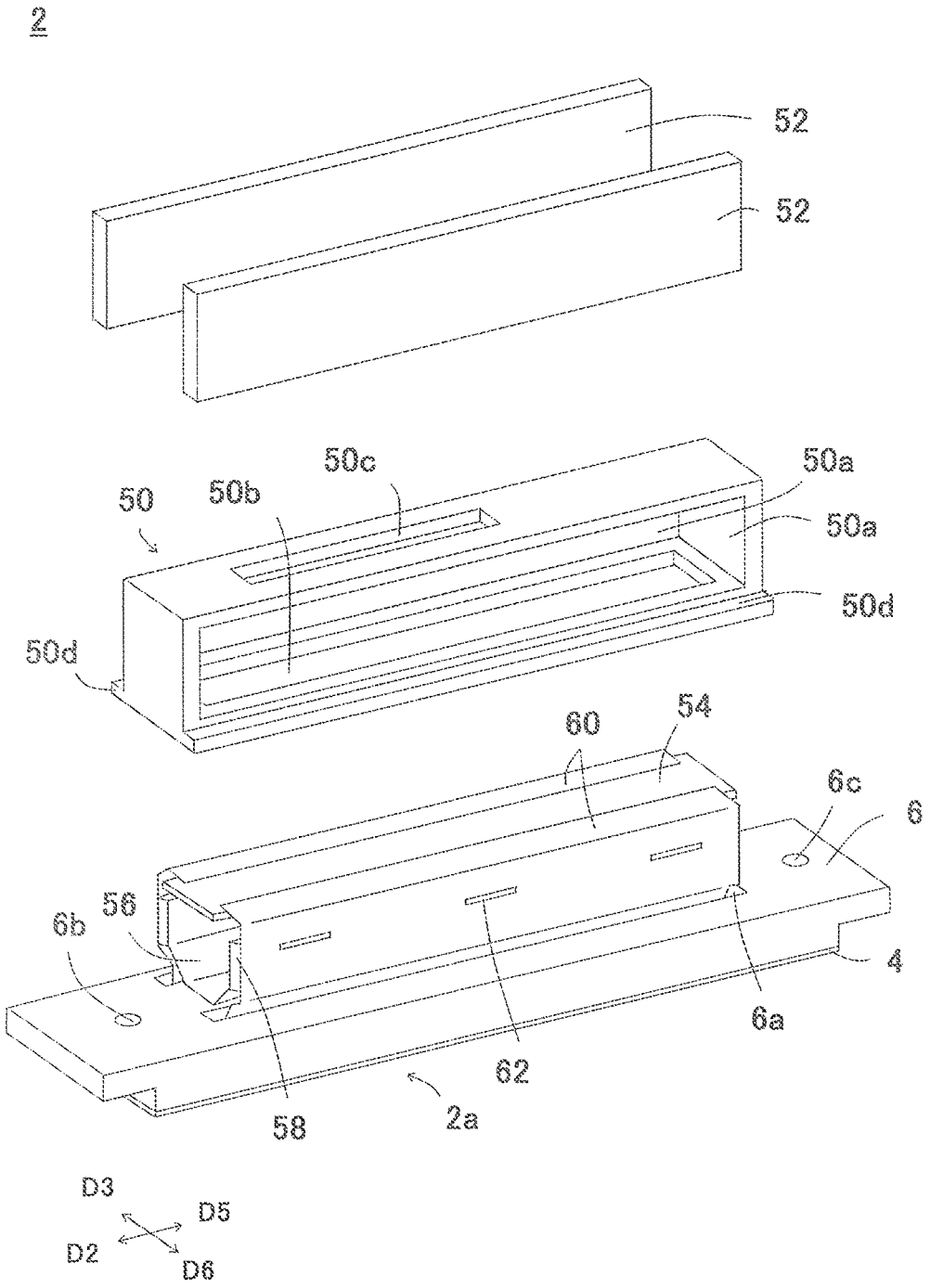
FIG. 2 is an exploded perspective view of the liquid discharge head according to the first embodiment of the present invention.
Figure 3A:
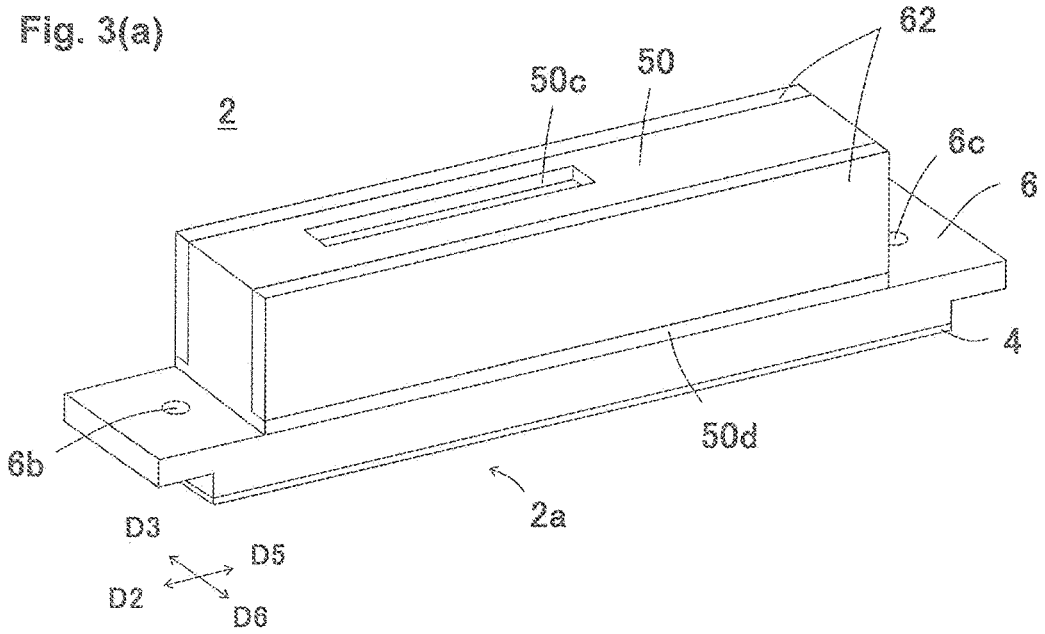
FIG. 3(*a*) is a perspective view of the liquid discharge head shown in FIG. 2, and FIG. 3(*b*) is a cross-sectional view of the liquid discharge head shown in FIG. 2.
Figure 3B:
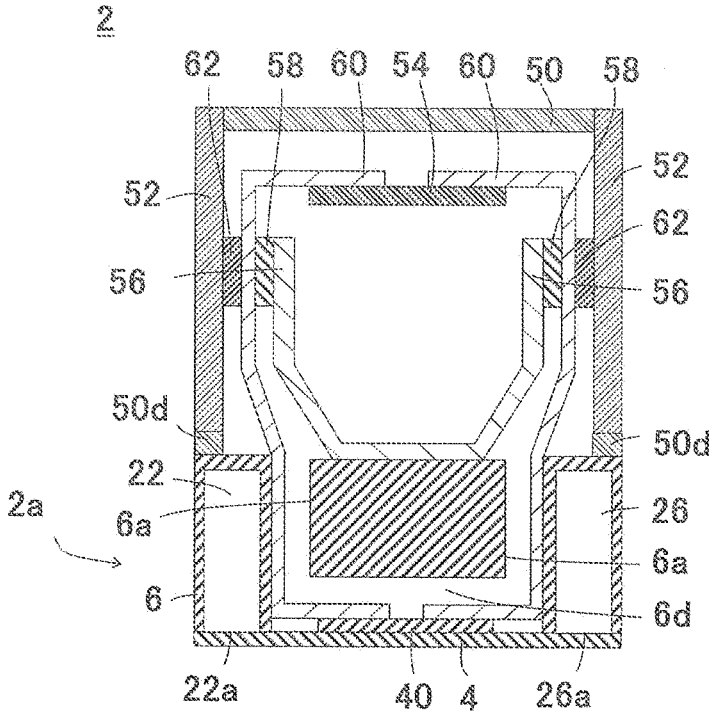

As shown in FIGS. 2 and 3, the liquid discharge head 2 includes a head body 2*a*, a housing 50, heat sinks 52, a circuit board 54, a press member 56, elastic members 58, signal transmission sections 60, and driver ICs 62. Moreover, the liquid discharge head 2 may at least include the head body 2*a*, and may not necessarily include the housing 50, the heat sinks 52, the circuit board 54, the press member 56, the elastic members 58, the signal transmission sections 60, and the driver ICs 62.

On the liquid discharge head 2, the signal transmission sections 60 extend from the head body 2*a*, and the signal transmission sections 60 are electrically connected to the circuit board 54. The signal transmission sections 60 are provided with the driver ICs 62 for driving and controlling the liquid discharge head 2. The driver ICs 62 are pressed onto the heat sinks 52 by the press member 56 via the elastic members 58. Moreover, a supporting member supporting the circuit board 54 is omitted from the drawings.

The heat sinks 52 may be formed of a metal or an alloy, and are provided to externally radiate heat of the driver ICs 62. The heat sinks 52 are joined to the housing 50 by means of a screw or an adhesive.

The housing 50 is mounted on an upper surface of the head body 2*a* so that the housing 50 and the heat sinks 52 cover each member configuring the liquid discharge head 2. The housing 50 includes first openings 50*a*, a second opening 50*b*, a third opening 50*c*, and thermal insulation sections 50*d*. The first openings 50*a* are provided to respectively face the third direction D3 and the sixth direction D6, and the first openings 50*a* are disposed with the heat sinks 52 so that the first openings 50*a* are sealed. The second opening 50*b* opens downwardly so that, via the second opening 50*b*, the circuit board 54 and the press member 56 are disposed inside the housing 50. The third opening 50*c* opens upwardly to house a connector (not shown) provided for the circuit board 54.

The thermal insulation sections 50*d* are provided to extend from the second direction D2 to the fifth direction D5, and are disposed between the heat sinks 52 and the head body 2*a*. Therefore, heat radiated to the heat sinks 52 is prevented as much as possible from being transmitted to the head body 2*a*. The housing 50 may be formed of a metal, an alloy, or a resin.

Figure 4A:
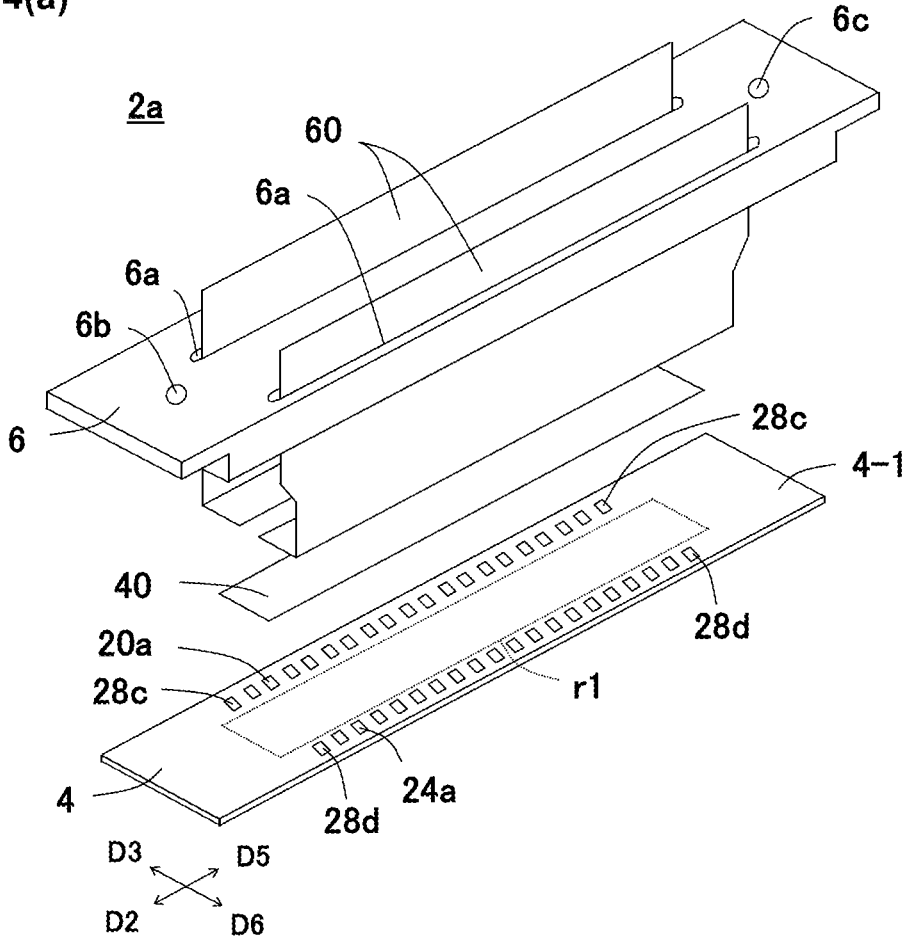
FIG. 4(*a*) is an exploded perspective view of a head body, and FIG. 4(*b*) is a perspective view of a second flow passage member when seen from an under surface of the second flow passage member.
Figure 4B:
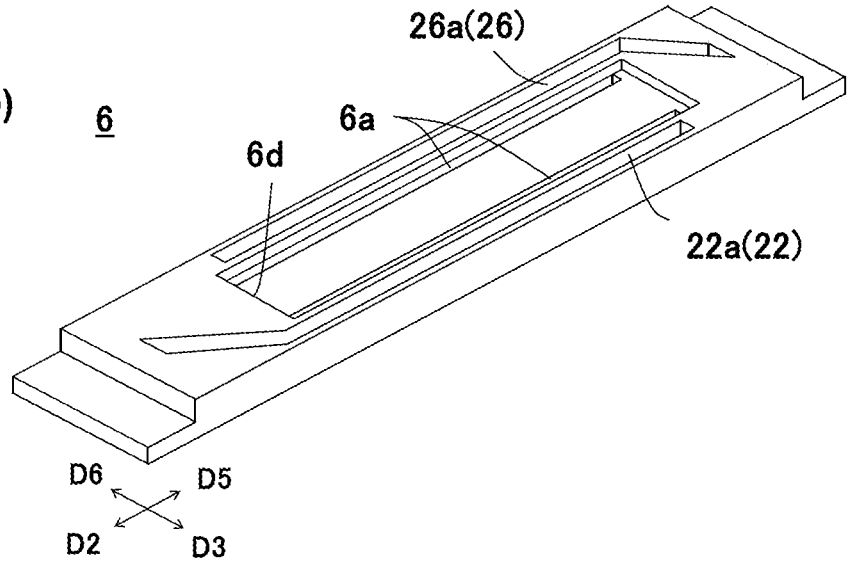

As shown in FIG. 4(*a*), the head body 2*a* has a tabular shape extending from the second direction D2 to the fifth direction D5, and has a first flow passage member 4, a second flow passage member 6, and a piezoelectric actuator substrate 40. On the head body 2*a*, the piezoelectric actuator substrate 40 and the second flow passage member 6 are disposed on an upper surface of the first flow passage member 4. The piezoelectric actuator substrate 40 is mounted in a region indicated with a broken line rl in FIG. 4(*a*). The piezoelectric actuator substrate 40 is provided to pressurize a plurality of pressurizing chambers 10 (see FIG. 8) provided on the first flow passage member 4, and includes a plurality of displacement elements (see FIG. 8).

Figure 8A:
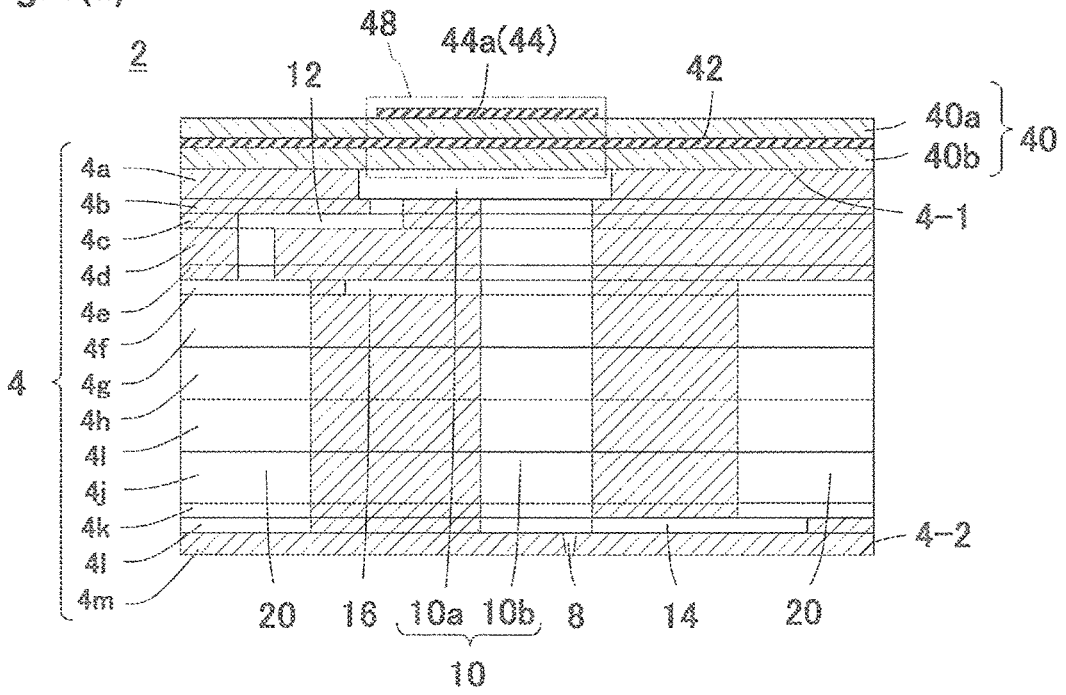
FIG. 8(*a*) is a cross-sectional view taken along the line VIIIa-VIIIa of FIG. 7(*b*), and FIG. 8(*b*) is a cross-sectional view taken along the line VIIIb-VIIIb of FIG. 7(*b*).

The first flow passage member 4 is internally formed with a plurality of flow passages to guide liquid supplied from the second flow passage member 6 to discharge holes 8 provided on an under surface (see FIG. 8). The first flow passage member 4 has, on its upper surface, a pressurizing chamber surface 4-1, and, on the pressurizing chamber surface 4-1, openings 20*a*, 24*a*, 28*c*, and 28*d* are formed. A plurality of the openings 20*a* is provided, and is arranged from the second direction D2 to the fifth direction D5. The openings 20*a* are disposed on an edge, in the third direction D3, of the pressurizing chamber surface 4-1. A plurality of the openings 24*a* is provided, and is arranged from the second direction D2 to the fifth direction D5. The openings 24*a* are disposed on another edge, in the sixth direction D6, of the pressurizing chamber surface 4-1. The openings 28*c* are provided on both outer sides, in the second direction D2 and the fifth direction D5, with the openings 20*a* provided therebetween. The openings 28*d* are provided on both outer sides, in the second direction D2 and the fifth direction D5, with the openings 23*a* provided therebetween.

The second flow passage member 6 is internally formed with a plurality of flow passages to guide liquid supplied from the liquid tank to the first flow passage member 4. The second flow passage member 6 is provided on an outer periphery portion of a pressurizing chamber surface 4-1 of the first flow passage member 4, and is joined to the first flow passage member 4, via an adhesive (not shown), outside the mount region of the piezoelectric actuator substrate 40.

Figure 5A:
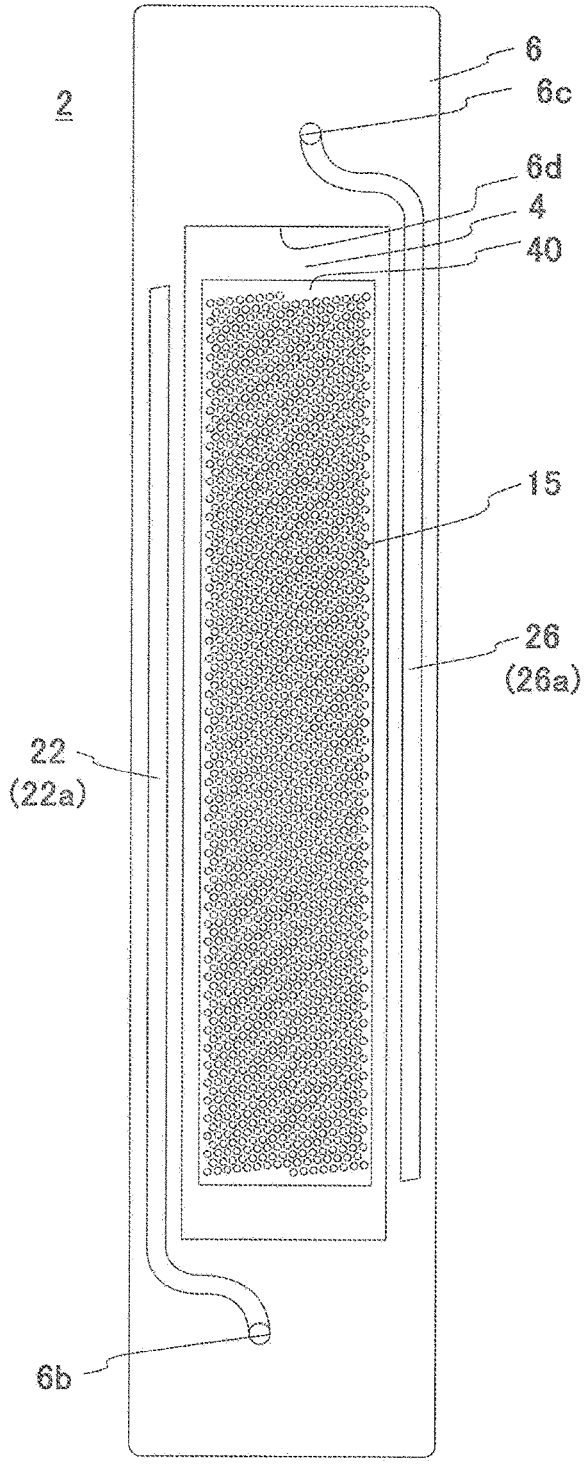
FIG. 5(*a*) is a plan view of the head body when the second flow passage member is partially made transparent, and FIG. 5(*b*) is another plan view of the head body when the second flow passage member is made transparent.
Figure 5B:
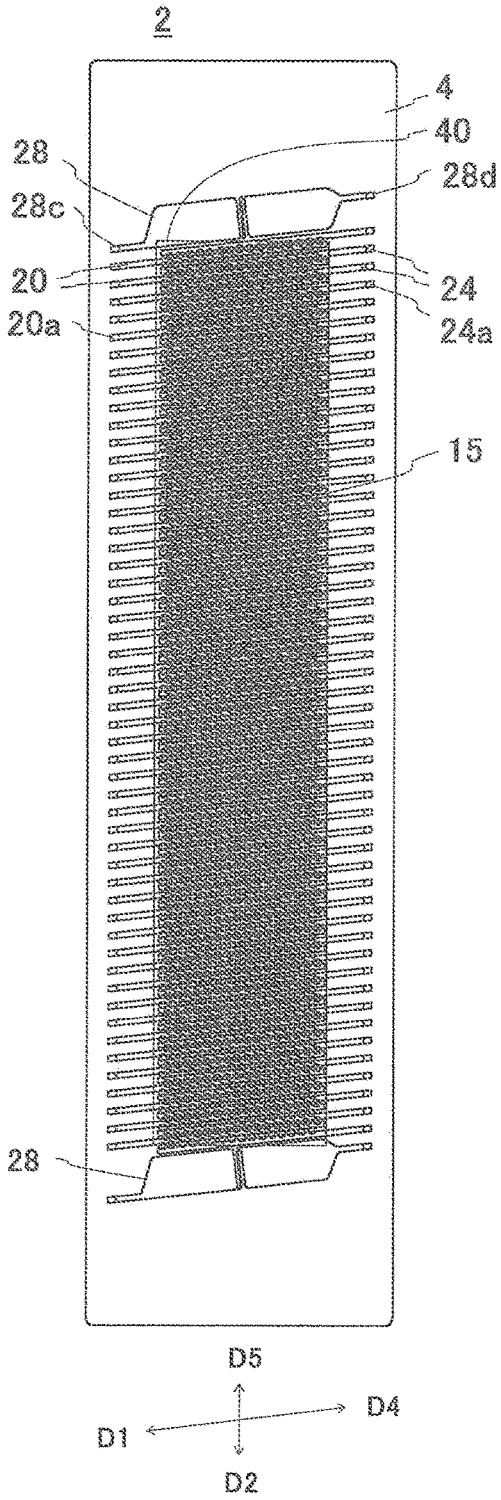

The second flow passage member 6 is, as shown in FIGS. 4 and 5, formed with through holes 6*a*, and openings 6*b*, 6*c*, 6*d*, 22*a*, and 26*a*. The through holes 6*a* are formed to extend from the second direction D2 to the fifth direction D5, and are disposed outside the mount region of the piezoelectric actuator substrate 40. The through holes 6*a* are inserted with the signal transmission sections 60.

The opening 6*b* is provided on an upper surface of the second flow passage member 6, and is disposed on an edge, in the second direction D2, of the second flow passage member. The opening 6*b* supplies liquid from the liquid tank to the second flow passage member 6. The opening 6*c* is provided on the upper surface of the second flow passage member 6, and is disposed on another edge, in the fifth direction D5, of the second flow passage member. The opening 6*c* collects the liquid from the second flow passage member 6 to the liquid tank. The opening 6*d* is provided on an under surface of the second flow passage member 6, and the piezoelectric actuator substrate 40 is disposed in a space formed by the opening 6*d*.

The opening 22*a* is provided on the under surface of the second flow passage member 6, and extends from the second direction D2 to the fifth direction D5. The opening 22*a* is formed on an edge, in the third direction D3, of the second flow passage member 6 so as to face toward the third direction D3 farther from the through hole 6*a*.

The opening 22*a* connects with the opening 6*b*, and forms the first integrated flow passage 22 when the opening 22*a* is sealed by the first flow passage member 4. The first integrated flow passage 22 is formed to extend from the second direction D2 to the fifth direction D5 to supply liquid to the openings 20*a* and the openings 28*c* of the first flow passage member 4.

The opening 26*a* is provided on the under surface of the second flow passage member 6, and extends from the second direction D2 to the fifth direction D5. The opening 26*a* is formed on another edge, in the sixth direction D6, of the second flow passage member 6 so as to face toward the sixth direction D6 farther from the through hole 6*a*.

The opening 26*a* connects with the opening 6*c*, and forms the second integrated flow passage 26 when the opening 26*a* is sealed by the first flow passage member 4. The second integrated flow passage 26 is formed to extend from the second direction D2 to the fifth direction D5 to supply liquid to the openings 24*a* and the openings 28*d* of the first flow passage member 4.

With a configuration described above, liquid supplied from the liquid tank to the opening 6*b* is supplied to the first integrated flow passage 22, and flows, via the opening 22*a*, into the first common flow passage 20 so that the liquid is supplied into the first flow passage member 4. And then the liquid collected through the second common flow passage 24 flows, via the opening 26*a*, into the second integrated flow passage 26 so that the liquid is collected externally via the opening 6*c*. Moreover, the second flow passage member 6 may not necessarily be provided.

As shown in FIGS. 5 to 8, the first flow passage member 4 is formed by laminating a plurality of plates 4*a* to 4*m*, and has, when viewed in a cross section in a lamination direction, the pressurizing chamber surface 4-1 provided on an upper side, and a discharge hole surface 4-2 provided on an lower side. On the pressurizing chamber surface 4-1, the piezoelectric actuator substrate 40 is disposed so that liquid is discharged from the discharge hole 8 opened on the discharge hole surface 4-2. A plurality of the plates 4*a* to 4*m* may each be formed of a metal, an alloy, or a resin. Moreover, the first flow passage member 4 may not be laminated with a plurality of the plates 4*a* to 4*m*, but may be integrally formed of a resin.

The first flow passage member 4 is formed with a plurality of the first common flow passages 20, a plurality of the second common flow passages 24, a plurality of edge flow passages 28, a plurality of the individual units 15, and a plurality of dummy individual units 17.

The first common flow passages 20 are provided to extend from the first direction D1 to the fourth direction D4, and formed to connects with the openings 20*a*. In addition, the first common flow passages 20 are arranged in multiple lines from the second direction D2 to the fifth direction D5.

The second common flow passages 24 are provided to extend from the fourth direction D4 to the first direction D1, and formed to communicate with the openings 24*a*. In addition, the second common flow passages 24 are arranged in multiple lines from the second direction D2 to the fifth direction D5, and disposed between the adjoining first common flow passages 20. Therefore, the first common flow passages 20 and the second common flow passages 24 are alternately disposed from the second direction D2 to the fifth direction D5.

Figure 8B:
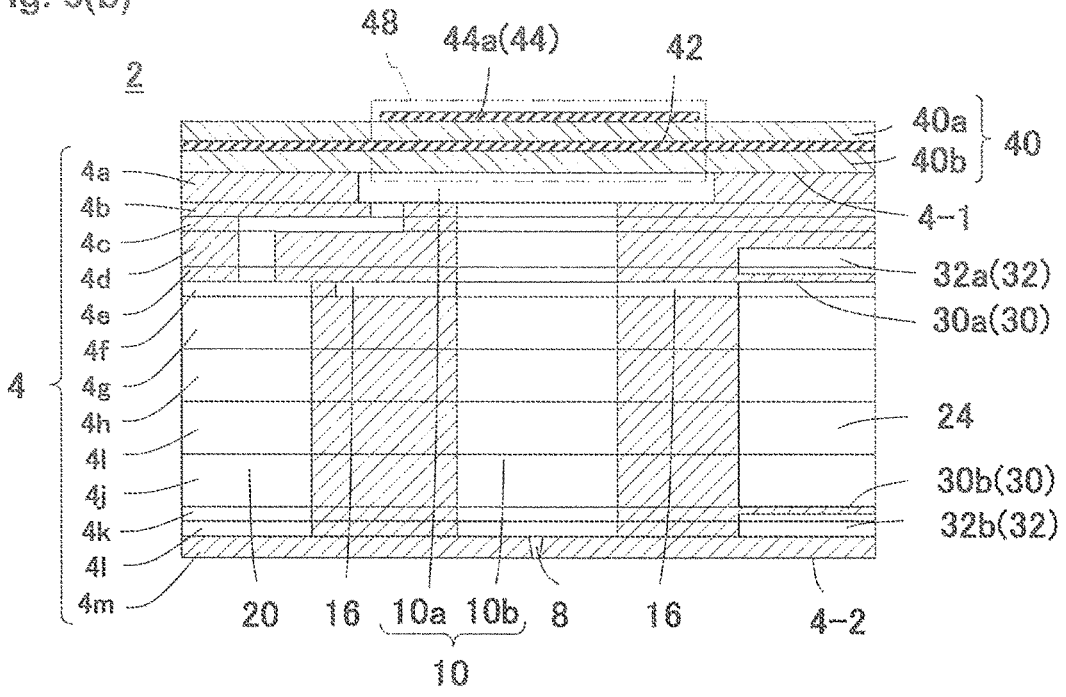

As shown in FIG. 8*b*, dampers 30 are formed in the second common flow passages 24 of the first flow passage member 4, and, via the dampers 30, spaces 32 each facing each of the second common flow passages 24 are disposed. The dampers 30 each include a first damper 30*a* and a second damper 30*b*. The spaces 32 each include a first space 32*a* and a second space 32*b*. The first space 32*a* is provided, with the first damper 30*a* interposed, above each of the second common flow passages 24 into which liquid flows. The second space 32*b* is provided, with the first damper 30*b* interposed, under each of the second common flow passages 24 into which the liquid flows.

The first damper 30*a* is formed approximately entirely over each of the second common flow passages 24. Therefore, when viewed in a plane, the first damper 30*a* has a shape identical to a shape of each of the second common flow passages 24. In addition, the first space 32*a* is formed approximately entirely over the first damper 30*a*. Therefore, when viewed in a plane, the first space 32*a* has a shape identical to the shape of each of the second common flow passages 24.

The second damper 30*b* is formed approximately entirely under each of the second common flow passages 24. Therefore, when viewed in a plane, the second damper 30*b* has a shape identical to a shape of each of the second common flow passages 24. In addition, the second space 32*b* is formed approximately entirely under the second damper 30*b*. Therefore, when viewed in a plane, the second space 32*b* has a shape identical to the shape of each of the second common flow passages 24.

The first damper 30*a* and the first space 32*a* can be formed by forming grooves through half etching on the plates 4*d* and 4*e*, and joining the plates 4*d* and 4*e* so that the grooves face each other. At this time, a portion of the plate 4*e*, remaining after half etching, becomes the first damper 30*a*. The second damper 30*b* and the second space 32*b* can be produced in a similar manner by forming grooves through half etching on the plates 4*k* and 4*l*.

The edge flow passages 28 are formed on both edges, in the second direction D2 and the fifth direction D5, of the first flow passage member 4. The edge flow passages 28 each have a wide section 28*a*, a narrow section 28*b*, and openings 28*c* and 28*d*. Liquid supplied from the opening 28*c* flows into each of the edge flow passages 28 in an order of the wide section 28*a*, the narrow section 28*b*, the wide section 28*a*, and the opening 28*d*. Therefore, the liquid is present in and flows into each of the edge flow passages 28 so as to unify a temperature around the edge flow passages 28 of the first flow passage member 4. Therefore, heat is less likely to be radiated from the edges, in the second direction D2 and the fifth direction D5, of the first flow passage member 4.

Figure 6:
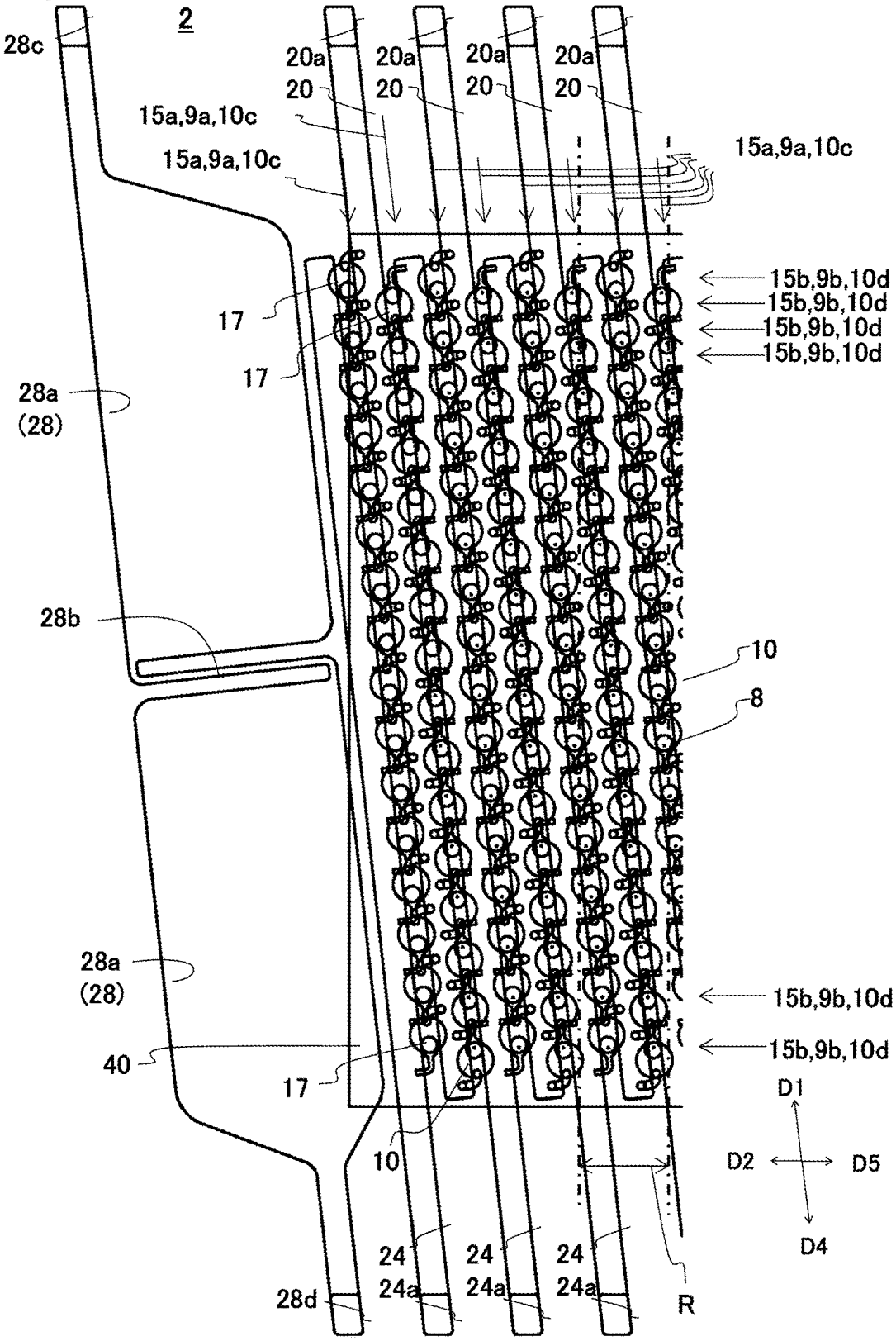
FIG. 6 is an enlarged plan view of a section of the head body as shown in FIG. 5.
Figure 7A:
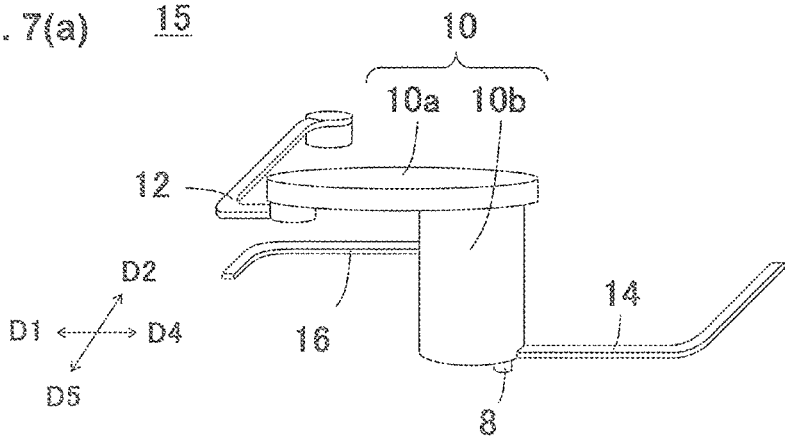
FIG. 7(*a*) is a perspective view of a discharge unit, FIG. 7(*b*) is a plan view of the discharge unit, and FIG. 7(*c*) is a plan view of an electrode disposed on the discharge unit.
Figure 7B:
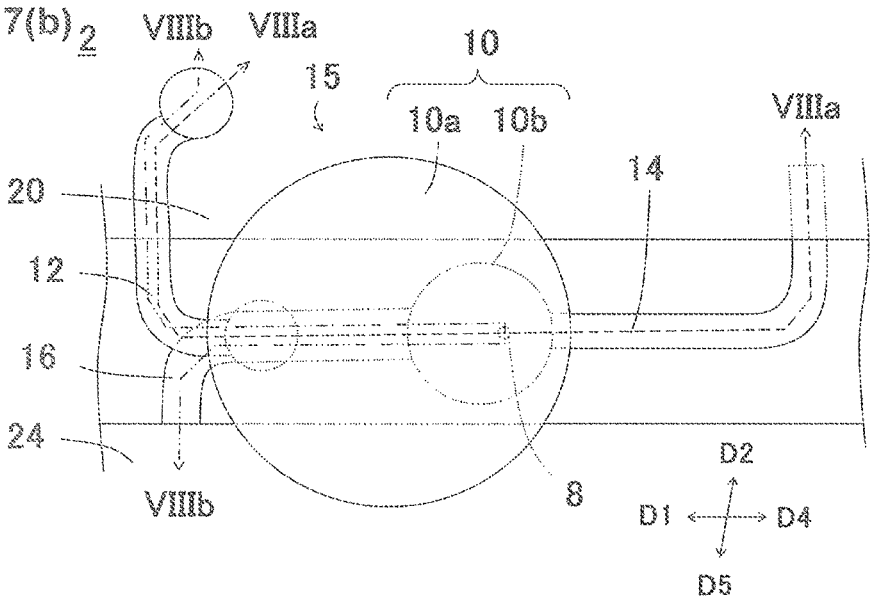
Figure 7C:
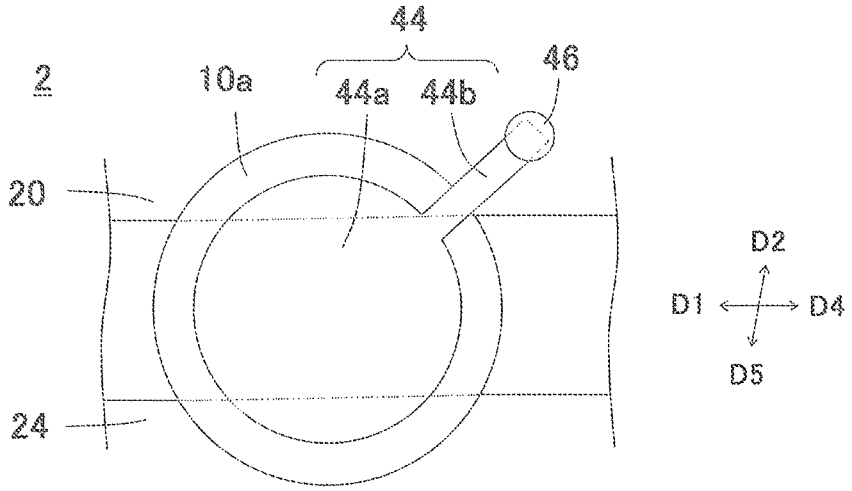

With reference to FIGS. 6 and 7, the discharge units 15 will now be described herein. The discharge units 15 each include the discharge hole 8, the pressurizing chamber 10, the first individual flow passage (first flow passage) 12, the second individual flow passage (third flow passage) 14, and the third individual flow passage (second flow passage) 16. Moreover, in the liquid discharge head 2, the liquid is supplied from the first individual flow passages 12 and the second individual flow passages 14 to the pressurizing chambers 10, and collected by the third individual flow passages 16 from the pressurizing chambers 10. Moreover, although details will be described later, a flow passage resistance in the second individual flow passages 14 is lower than a flow passage resistance in the first individual flow passages 12.

The discharge units 15 are provided between the adjoining first common flow passages 20 and the second common flow passages 24, and are formed in a matrix shape in a surface direction of the first flow passage member 4. The discharge units 15 have discharge unit columns 15*a* and discharge unit lines 15*b*. The discharge unit columns 15*a* are arranged from the first direction D1 to the fourth direction D4. The discharge unit lines 15*b* are arranged from the second direction D2 to the fifth direction D5.

The pressurizing chambers 10 have pressurizing chamber columns 10*c* and pressurizing chamber lines 10*d*. In addition, the discharge holes 8 have discharge hole columns 9*a* and discharge hole lines 9*b*. The discharge hole columns 9*a* and the pressurizing chamber columns 10*c* are arranged in a similar manner from the first direction D1 to the fourth direction D4. In addition, the discharge hole lines 9*b* and the pressurizing chamber lines 10*d* are arranged in a similar manner from the second direction D2 to the fifth direction D5.

Angles between a line formed by the first direction D1 and the fourth direction D4 and a line formed by the second direction D2 and the fifth direction D5 are each offset from a right angle. Because of this, the discharge holes 8 belonging to the discharge hole columns 9*a* disposed in the first direction D1 are each other disposed by the offset from the right angle toward the second direction D2. And then, since the discharge hole columns 9*a* are disposed in parallel to the second direction D2, the discharge holes 8 belonging to the different discharge hole columns 9*a* are disposed by the offset toward the second direction D2. In combination of these offsets, the discharge holes 8 of the first flow passage member 4 are disposed at a predetermined interval in the second direction D2. Therefore, printing is possible to fill a predetermined region with a pixel formed by the discharged liquid.

In FIG. 6, when the discharge holes 8 are projected in the third direction D3 and the sixth direction D6, the thirty-two (32) discharge holes 8 are projected in a region indicated by virtual straight lines R, and, within the virtual straight lines R, the discharge holes 8 each align at an interval of 360 dpi. Therefore, when the recording medium P is conveyed in a direction orthogonal to the virtual straight lines R for printing, printing is possible at a resolution of 360 dpi.

The dummy discharge units 17 are provided between a farthest one, in the second direction D2, of the first common flow passages 20 and a farthest one, in the second direction D2, of the second common flow passages 24. In addition, the dummy discharge units 17 are also provided between a farthest one, in the fifth direction D5, of the first common flow passages 20 and a farthest one, in the fifth direction D5, of the second common flow passages 24. The dummy discharge units 17 are provided to stabilize the liquid discharged from a farthest one, in the second direction D2 or the fifth direction D5, of the discharge unit columns 15*a*.

The pressurizing chamber 10 has, as shown in FIGS. 7 and 8, a pressurizing chamber body 10*a* and a partial flow passage 10*b*. The pressurizing chamber body 10*a* has a circular shape, when viewed in a plane, and the partial flow passage 10*b* extends downwardly from a center of the pressurizing chamber body 10*a*.

The pressurizing chamber body 10*a* accepts pressure from the displacement element 48 disposed on the pressurizing chamber body 10*a* to pressurize the liquid in the partial flow passage 10*b*.

The pressurizing chamber body 10*a* has an approximately disc shape in a side view of FIG. 7*a*, and a circular shape in the planar view of FIG. 7*b*. The circular shape can increase an amount of displacement, and therefore can increase a volumetric change caused by the displacement in each of the pressurizing chambers 10. The partial flow passage 10*b* has an approximately columnar shape having a diameter smaller than a diameter of the pressurizing chamber body 10*a*, and in the planar view shows a circular shape. In addition, the partial flow passage 10*b* is accommodated, inside the pressurizing chamber body 10*a* when viewed from the pressurizing chamber surface 4-1.

Moreover, the partial flow passage 10*b* may have a conical shape or a truncated conical shape where a cross-sectional area decreases toward the discharge hole 8. Therefore, widths between the first common flow passages 20 and the second common flow passages 24 can be increased to reduce a difference in pressure loss.

The pressurizing chambers 10 are disposed along both sides of each of the first common flow passages 20 to configure the pressurizing chamber columns 10*c*, one column on each side, two columns in total. The first common flow passages 20 and the pressurizing chambers 10 disposed in parallel on both sides of each of the first common flow passages 20 are connected via the first individual flow passages 12 and the second individual flow passages 14.

In addition, the pressurizing chambers 10 are disposed along both sides of each of the second common flow passages 24 to configure the pressurizing chamber columns 10*c*, one column on each side, two columns in total. The second common flow passages 24 and the pressurizing chambers 10 disposed in parallel on both sides of each of the second common flow passages 24 are connected via the third individual flow passages 16.

With reference to FIG. 7, the first individual flow passages 12, the second individual flow passages 14, and the third individual flow passages 16 will now be described herein.

The first individual flow passages 12 each connect each of the first common flow passages 20 and the pressurizing chamber body 10*a*. After extended upwardly from upper surfaces of the first common flow passages 20, the first individual flow passages 12 each extend toward the fifth direction D5, extend toward the fourth direction D4, extend again upwardly, and are each connected to an under surface of the pressurizing chamber body 10*a*.

The second individual flow passages 14 each connect each of the first common flow passages 20 and the partial flow passage 10*b*. After extended from under surfaces of the first common flow passages 20 toward the fifth direction D5, and then extended toward the first direction D1, the second individual flow passages 14 are each connected to a side surface of the partial flow passage 10*b*.

The third individual flow passages 16 each connect each of the second common flow passages 24 and the partial flow passage 10*b*. After extended from side surfaces of the second common flow passages 24 toward the second direction D2, and then extended toward the fourth direction D4, the third individual flow passages 16 are each connected to the side surface of the partial flow passage 10*b*.

The flow passage resistance in the second individual flow passages 14 is lower than the flow passage resistance in the first individual flow passages 12. To lower the flow passage resistance in the second individual flow passages 14 than the flow passage resistance in the first individual flow passages 12, for example, a thickness of the plate 4*l* by which the second individual flow passages 14 are formed may be set larger than a thickness of the plate 4*c* by which the first individual flow passages 12 are formed. In addition, when viewed in a plane, widths of the second individual flow passages 14 may be greater than widths of the first individual flow passages 12. In addition, when viewed in a plane, lengths of the second individual flow passages 14 may be less than lengths of the first individual flow passage 12.

With a configuration described above, in the first flow passage member 4, the supplied liquid flows, via the openings 20*a*, to the first common flow passages 20, and then via the first individual flow passages 12 and the second individual flow passages 14, into the pressurizing chambers 10, and is partially discharged from the discharge holes 8. And then the remaining liquid flows from the pressurizing chambers 10, via the third individual flow passages 16, to the second common flow passages 24, and then is discharged from the first flow passage member 4, via the openings 24*a*, to the second flow passage member 6.

With reference to FIG. 8, the piezoelectric actuator substrate 40 will now be described herein. On an upper surface of the first flow passage member 4, the piezoelectric actuator substrate 40 including the displacement elements 48 is joined so that the displacement elements 48 are disposed in position on the pressurizing chambers 10. The piezoelectric actuator substrate 40 occupies a region having a shape approximately identical to a shape of a pressurizing chamber group formed with the pressurizing chambers 10. In addition, an opening of each of the pressurizing chambers 10 closes when the piezoelectric actuator substrate 40 is joined onto the pressurizing chamber surface 4-1 of the first flow passage member 4.

The piezoelectric actuator substrate 40 has a structure laminated with two piezoelectric ceramic layers 40*a* and 40*b* each including a piezoelectric material. The piezoelectric ceramic layers 40*a* and 40*b* each have a thickness of approximately 20 μm. Both the piezoelectric ceramic layers 40*a* and 40*b* extend over a plurality of the pressurizing chambers 10.

The piezoelectric ceramic layers 40*a* and 40*b* include, for example, a ceramic material having ferroelectricity, such as lead zirconate titanate (PZT) type, $NaNbO_3$ type, $BaTiO_3$ type, $(BiNa)NbO_3$ type, and $BiNaNb_5O_{15}$ type. Moreover, the piezoelectric ceramic layer 40*b* functions as a vibrating plate, and does not necessarily include a piezoelectric material, but may use a ceramic layer other than piezoelectric material and a metal plate.

The piezoelectric actuator substrate 40 is formed with a common electrode 42, individual electrodes 44, and connection electrodes 46. The common electrode 42 is formed approximately entirely in a surface direction on a region between the piezoelectric ceramic layer 40*a* and the piezoelectric ceramic layer 40*b*. In addition, the individual electrodes 44 are respectively disposed at positions on an upper surface of the piezoelectric actuator substrate 40 so as to face the pressurizing chambers 10.

Portions interposed between the individual electrodes 44 and the common electrode 42 of the piezoelectric ceramic layer 40*a* are polarized in a thickness direction so as to form the displacement elements 48 each having a unimorph structure that is displaced when a voltage is applied onto the individual electrodes 44. Accordingly, the piezoelectric actuator substrate 40 has a plurality of the displacement elements 48.

The common electrode 42 can be formed of a metallic material such as Ag—Pd type, and a thickness of the common electrode 42 may be approximately 2 μm. The common electrode 42 has a surface electrode (not shown) for the common electrode 42 on the piezoelectric ceramic layer 40*a*, and the surface electrode for the common electrode 42 is connected to the common electrode 42 via a via hole formed when the surface electrode for the common electrode 42 penetrates into the piezoelectric ceramic layer 40*a*, and is grounded so that a ground potential is retained.

The individual electrodes 44 are each formed of a metallic material such as Au type, and each have an individual electrode body 44*a* and an extraction electrode 44*b*. As shown in FIG. 7(*c*), the individual electrode body 44*a* is formed in an approximately circular shape when viewed in a plane, and is formed smaller than the pressurizing chamber body 10*a*. The extraction electrode 44*b* extends from the individual electrode body 44*a*, and, onto the extended extraction electrode 44*b*, to where the connection electrodes 46 are formed.

The connection electrodes 46 include, for example, silver-palladium including glass frit, and are each formed protrudingly with a thickness of approximately 15 μm. The connection electrodes 46 are electrically joined to electrodes provided to the signal transmission sections 60.

The liquid discharge head 2 causes the displacement elements 48 to displace, through a control by the control section 76 via the driver ICs 62 and other devices, in accordance with a drive signal supplied to the individual electrodes 44. As a driving method, a so-called pull driving method can be used.

Figure 9:
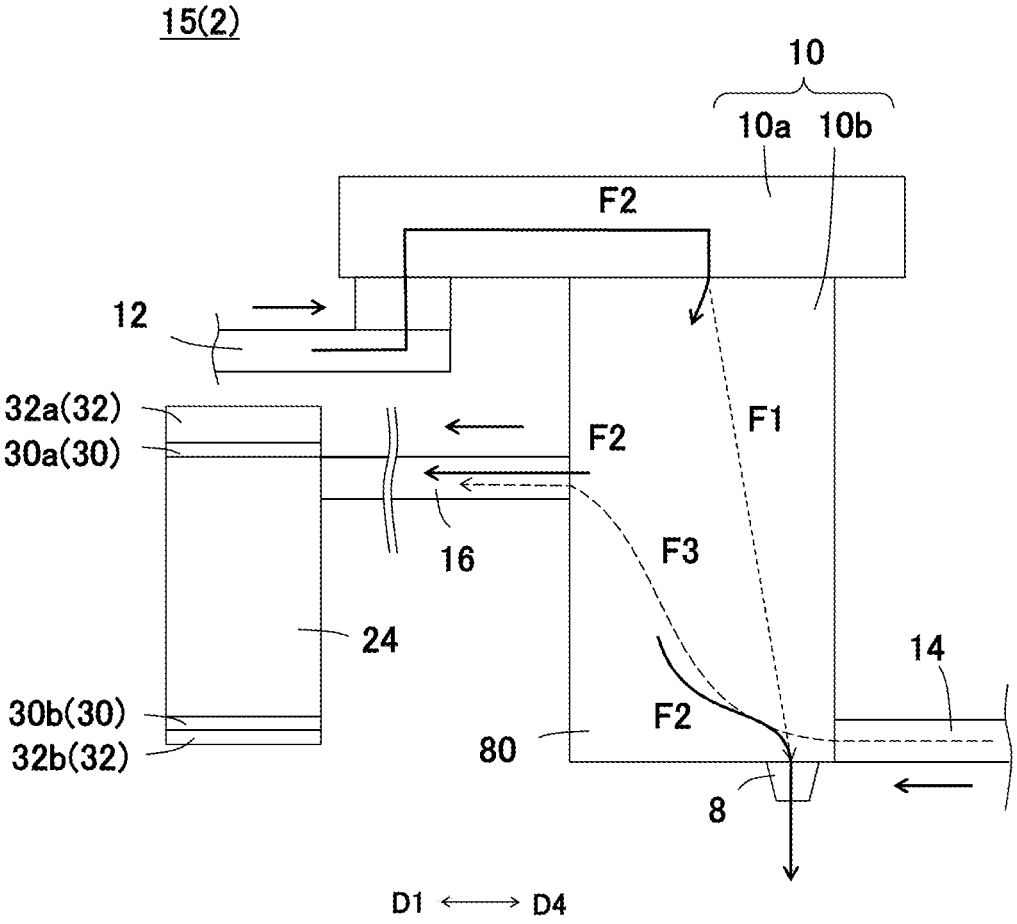
FIG. 9 is a schematic view illustrating a flow of a fluid in a liquid discharge unit.
Figure 10A:
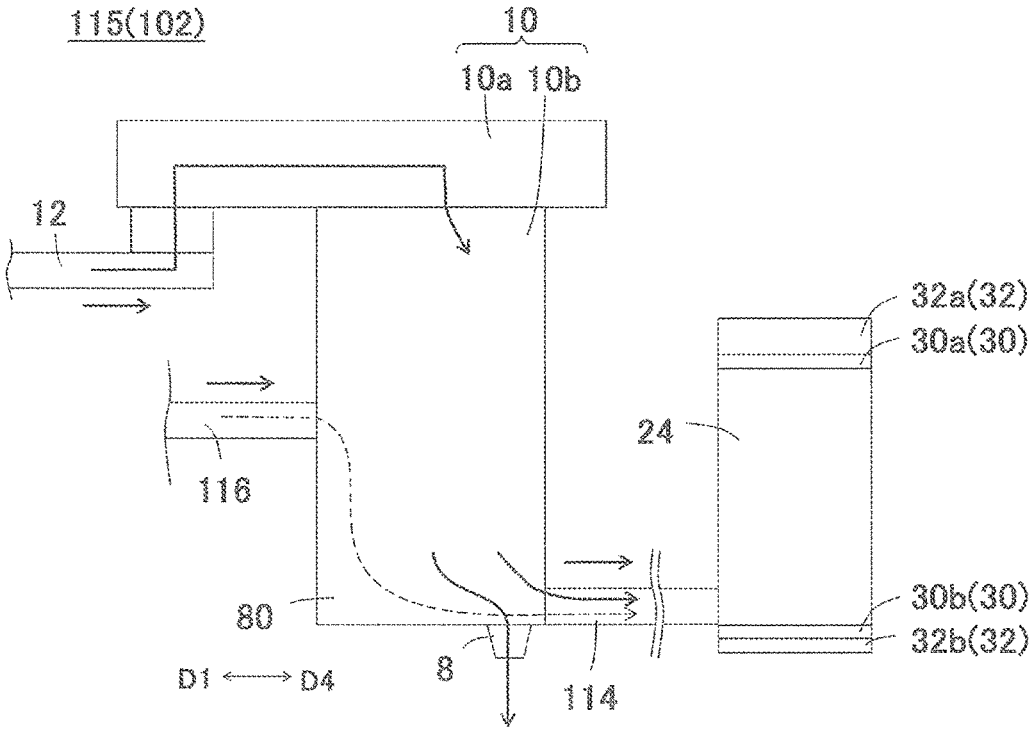
FIGS. 10(*a*) and 10(*b*) illustrates a liquid discharge head according to a second embodiment, where FIG. 10(*a*) is a schematic view illustrating a flow of a fluid in a liquid discharge unit, and FIG. 10(*b*) is a plan view of the discharge unit.
Figure 10B:
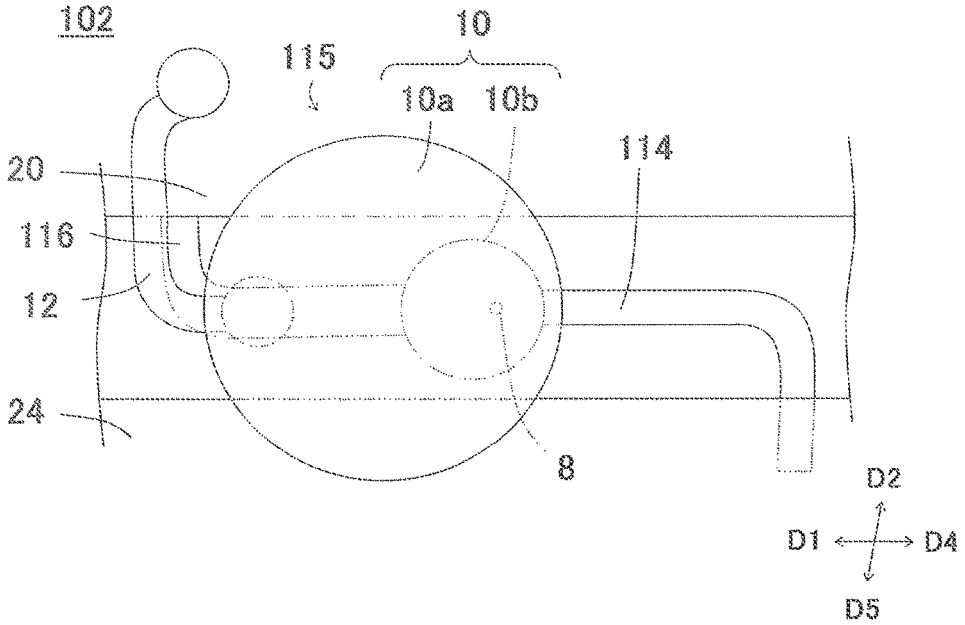

With reference to FIGS. 9 and 10, the discharge units 15 of the liquid discharge head 2 will now be described herein in detail.

The discharge units 15 each include the discharge hole 8, the pressurizing chamber 10, the first individual flow passage (first flow passage) 12, the second individual flow passage (third flow passage) 14, and the third individual flow passage (second flow passage) 16. The first individual flow passage 12 and the second individual flow passage 14 are connected to the first common flow passage 20 (fifth flow passage (see FIG. 8)), and the third individual flow passage 16 is connected to the second common flow passage 24 (fourth flow passage (see FIG. 8)).

The first individual flow passage 12 is connected, on a side facing the first direction D1, to the pressurizing chamber body 10*a* of the pressurizing chamber 10. The second individual flow passage 14 is connected, on a side facing the fourth direction D4, to the partial flow passage 10*b* of the pressurizing chamber 10. The third individual flow passage 16 is connected, on a side facing the first direction D1, to the partial flow passage 10*b* of the pressurizing chamber 10.

The liquid supplied from the first individual flow passage 12 passes into the pressurizing chamber body 10*a* to flow downwardly into the partial flow passage 10*b*, and is partially discharged from the discharge hole 8. The liquid that is not discharged from the discharge hole 8 is collected, via the third individual flow passage 16, outside the discharge unit 15.

The liquid supplied from the second individual flow passage 14 is partially discharged from the discharge hole 8. The liquid that is not discharged from the discharge hole 8 flows upwardly into the partial flow passage 10*b*, and is collected, via the third individual flow passage 16, outside the discharge unit 15.

As shown in FIG. 9, the liquid supplied from the first individual flow passage 12 flows into the pressurizing chamber body 10*a* and the partial flow passage 10*b*, and is discharged from the discharge hole 8. In a conventional discharge unit, the liquid flows, as shown with a broken line, evenly and approximately linearly from a center portion of the pressurizing chamber body 10*a* toward the discharge hole 8.

Such a flow forms a configuration where, in the pressurizing chamber 10, the liquid is difficult to flow around a region 80 positioned opposite to a portion connected with the second individual flow passage 14, thus, for example, a region in which the liquid stagnates is likely to be created around the region 80.

In response to this, the first individual flow passage 12 and the second individual flow passage 14 are connected to the pressurizing chamber 10, and the third individual flow passage 16 connected to the pressurizing chamber 10 is provided so as to supply the liquid to the pressurizing chamber 10.

Therefore, the liquid flowing from the first individual flow passage 12 to the discharge hole 8 for supply and the liquid flowing from the second individual flow passage 14 to the pressurizing chamber 10 for supply can collide. Therefore, the liquid supplied from the pressurizing chamber 10 to the discharge hole 8 is less likely to flow evenly and approximately linearly, thus a region in which the liquid stagnates can be prevented as much as possible from being created in the pressurizing chamber 10.

That is, a position of a point, at which the liquid stagnates when the liquid supplied from the pressurizing chamber 10 to the discharge hole 8 flows, changes due to a collision with the liquid flowing from the pressurizing chamber 10 to the discharge hole 8 for supply, thus a region in which the liquid stagnates can be prevented as much as possible from being created in the pressurizing chamber 10.

In addition, the pressurizing chamber 10 includes the pressurizing chamber body 10*a* and the partial flow passage 10*b*, where the first individual flow passage 12 is connected to the pressurizing chamber body 10*a*, and the second individual flow passage 14 is connected to the partial flow passage 10*b*. Therefore, since the first individual flow passage 12 supplies the liquid so that the liquid flows entirely into the pressurizing chamber 10, and the liquid supplied from the second individual flow passage 14 flows into the partial flow passage 10*b*, a region in which the liquid stagnates is prevented as much as possible from being created in the partial flow passage 10*b*.

In addition, the third individual flow passage 16 is connected to the partial flow passage 10*b*. Therefore, a configuration is created, where the liquid flowing from the second individual flow passage 14 to the third individual flow passage 16 flows across the partial flow passage 10*b*. As a result, the liquid can flow from the second individual flow passage 14 to the third individual flow passage 16 so as to cross a flow of the liquid supplied from the pressurizing chamber body 10*a* to the discharge hole 8. Therefore, a region in which the liquid stagnates is further prevented as much as possible from being created in the partial flow passage 10*b*.

Moreover, the third individual flow passage 16 may be connected to the pressurizing chamber body 10*a*. Also in such a case, the liquid flowing from the pressurizing chamber body 10*a* to the discharge hole 8 for supply and the liquid flowing from the second individual flow passage 14 for supply can collide. As a result, a region in which the liquid stagnates is prevented as much as possible from being created in the pressurizing chamber body 10*a*.

In addition, the third individual flow passage 16 is connected to the partial flow passage 10*b* so that the third individual flow passage 16 is closer, than the second individual flow passage 14, to the pressurizing chamber body 10*a*. As a result, even if an air bubble enters from the discharge port 8 into the partial flow passage 10*b*, the air bubble can exit from the third individual flow passage 16 by its buoyancy. Therefore, a possibility of negatively affecting pressure propagation to the liquid due to the air bubble stagnated in the partial flow passage 10*b* can be reduced.

In addition, when viewed in a plane, the first individual flow passage 12 is connected, on the side facing the first direction D1, to the pressurizing chamber body 10*a*, and the second individual flow passage 14 is connected, on the side facing the fourth direction D4, to the partial flow passage 10*b*.

Therefore, when viewed in a plane, the separate unit 15 is supplied with the liquid from both the first direction D1 and the fourth direction D4. Therefore, the supplied liquid can have a velocity component of the first direction D1 and a velocity component of the fourth direction D4. Therefore, the liquid supplied into the pressurizing chamber 10 agitates the liquid in the partial flow passage 10*b*. As a result, a region in which the liquid stagnates is further prevented as much as possible from being created in the partial flow passage 10*b*.

In addition, the third individual flow passage 16 is connected, on the side facing the first direction D1, to the partial flow passage 10*b*, and the discharge hole 8 is disposed, on the side facing the fourth direction D4, on the partial flow passage 10*b*. Therefore, the liquid can flow toward the first direction D1 in the partial flow passage 10*b*, thus a region in which the liquid stagnates is prevented as much as possible from being created in the partial flow passage 10*b*.

Moreover, such a configuration where the third individual flow passage 16 is connected to the partial flow passage 10*b*, on the side facing the fourth direction D4, and the discharge hole 8 is disposed, on the side facing the first direction D1, on the partial flow passage 10*b* may be applied. Also in such a case, a similar effect of preventing stagnation can be obtained.

In addition, as shown in FIGS. 8(*a*) and 8(*b*), the third individual flow passage 16 is connected, on a side facing the pressurizing chamber body 10*a*, to the second common flow passage 24. Therefore, an air bubble discharged from the partial flow passage 10*b* can flow along an upper surface of the second common flow passage 24. Therefore, the air bubble can easily exit externally, via the openings 24*a*, from the second common flow passage 24 (see FIG. 6).

In addition, it is preferable that an upper surface of the third individual flow passage 16 and the upper surface of the second common flow passage 24 are formed flush. Therefore, the air bubble discharged from the partial flow passage 10*b* flows along the upper surface of the third individual flow passage 16 and the upper surface of the second common flow passage 24, thus the air bubble can further easily exit externally.

In addition, the second individual flow passage 14 is connected closer, than the third individual flow passage 16, to the discharge hole 8 of the partial flow passage 10*b*. Therefore, around the discharge hole 8, the liquid is supplied from the second individual flow passage 14. Accordingly, a speed of the liquid flowing around the discharge hole 8 can be increased, thus the discharge hole 8 is prevented as much as possible from being clogged due to a settled pigment or other materials contained in the liquid.

In addition, as shown in FIG. 7(*b*), when viewed in a plane, the first individual flow passage 12 is connected, on the side facing the first direction D1, to the pressurizing chamber body 10*a*, and an area center of gravity of the partial flow passage 10*b* is positioned closer to the fourth direction D4 than an area center of gravity of the pressurizing chamber body 10*a*. That is, the partial flow passage 10*b* is connected, on a far side from the first individual flow passage 12, to the pressurizing chamber body 10*a*.

Therefore, the liquid supplied, to the side facing the first direction D1, into the pressurizing chamber body 10*a* expands entirely into the pressurizing chamber body 10*a*, and then is supplied to the partial flow passage 10*b*. As a result, a region in which the liquid stagnates is prevented as much as possible from being created in the pressurizing chamber body 10*a*.

In addition, when viewed in a plane, the discharge hole 8 is disposed between the second individual flow passage 14 and the third individual flow passage 16. Therefore, a position where, when the liquid is discharged from the discharge hole 8, the liquid flowing from the pressurizing chamber body 10*a* to the discharge hole 8 and the liquid flowing from the second individual flow passage 14 collide can be changed.

That is, an amount of the liquid discharged from the discharge hole 8 can differ depending on an image to be printed, thus, in accordance with increase or decrease of the amount of the liquid to be discharged, behavior of the liquid in the partial flow passage 10*b* can change. Therefore, in accordance with increase or decrease of the amount of the liquid to be discharged, a position where the liquid flowing from the pressurizing chamber body 10*a* to the discharge hole 8 and the liquid flowing from the second individual flow passage 14 collide changes, thus a region in which the liquid stagnates is prevented as much as possible from being created in the partial flow passage 10*b*.

In addition, an area center of gravity of the discharge hole 8 is positioned closer, than the area center of gravity of the partial flow passage 10*b*, to the fourth direction D4. Therefore, the liquid supplied to the partial flow passage 10*b* expands entirely in the partial flow passage 10*b*, and then the liquid is supplied to the discharge hole 8. Thus, a region in which the liquid stagnates is prevented as much as possible from being created in the partial flow passage 10*b*.

At this point, the discharge unit 15 is connected, via the first individual flow passage 12 (first flow passage) and the second individual flow passage 14 (third flow passage), to the first common flow passage 20 (fifth flow passage). Therefore, part of pressure applied to the pressurizing chamber body 10*a* propagates, via the first individual flow passage 12 and the second individual flow passage 14, to the first common flow passage 20.

If a pressure wave propagates from the first individual flow passage 12 and the second individual flow passage 14 to the first common flow passage 20 to generate a pressure difference in the first common flow passage 20, behavior of the liquid in the first common flow passage 20 can become unstable. However, it is preferable that a magnitude of a pressure wave propagating to the first common flow passage 20 is uniform.

In the liquid discharge head 2, when viewed in a cross section, the second individual flow passage 14 is disposed lower than the first individual flow passage 12. Therefore, a distance from the pressurizing chamber body 10*a* to the second individual flow passage 14 is longer than a distance from the pressurizing chamber body 10*a* to the first individual flow passage 12. Thus, when pressure propagates to the second individual flow passage 14, the pressure attenuates.

And then, since the flow passage resistance in the second individual flow passage 14 is lower than the flow passage resistance in the first individual flow passage 12, a magnitude of pressure attenuation when the liquid flows into the second individual flow passage 14 can be reduced below a magnitude of pressure attenuation when the liquid flows into the first individual flow passage 12. As a result, magnitudes of pressure waves propagated from the first individual flow passage 12 and the second individual flow passage 14 can be almost uniform.

That is, a total of a magnitude of pressure attenuation when the liquid flows from the pressurizing chamber body 10*a* to the first individual flow passage 12 or the second individual flow passage 14 and a magnitude of pressure attenuation when the liquid flows into the first individual flow passage 12 or the second individual flow passage 14 can be almost uniform between the first individual flow passage 12 and the second individual flow passage 14. Thus, a magnitude of a pressure wave propagating into the first common flow passage 20 can be almost uniform.

In addition, when viewed in a cross section, the third individual flow passage 16 is disposed higher than the second individual flow passage 14, but lower than the first individual flow passage 12. In other words, the third individual flow passage 16 is disposed between the first individual flow passage 12 and the second individual flow passage 14. Therefore, when pressure is applied to the pressurizing chamber body 10*a* propagates into the second individual flow passage 14, the pressure partially propagates into the third individual flow passage 16.

With regard to this, the flow passage resistance in the second individual flow passage 14 is lower than the flow passage resistance in the first individual flow passage 12. Therefore, a magnitude of a pressure wave reaching the second individual flow passage 14 decreases, and thus a magnitude of pressure attenuation in the second individual flow passage 14 decreases. So a magnitude of a pressure wave propagated from the first individual flow passage 12 and the second individual flow passage 14 can be almost uniform.

A flow passage resistance in the first individual flow passage 12 can be 1.03 to 2.5 times greater than a flow passage resistance in the second individual flow passage 14.

In another example, a flow passage resistance in the second individual flow passage 14 may be greater than a flow passage resistance in the first individual flow passage 12. In this case, propagation of pressure from the first common flow passage 20 via the second individual flow passage 14 can be minimized. As a result, a possibility of propagating unnecessary pressure, through pressure propagation from the second individual flow passage 14, into the discharge hole 8 can be reduced.

A flow passage resistance in the second individual flow passage 14 can be 1.03 to 2.5 times greater than flow passage resistance in the first individual flow passage 12.

Moreover, although an example where the pressurizing chamber 10 includes the pressurizing chamber body 10*a* and the partial flow passage 10*b* has been described, the pressurizing chamber 10 does not necessarily include the pressurizing chamber body 10*a* and the partial flow passage 10*b*. For example, another pressurizing chamber 10 does not include the partial flow passage 10*b*, but includes only the pressurizing chamber body 10*a*. In this case, the first individual flow passage 12, the second individual flow passage 14, and the third individual flow passage 16 are respectively connected to the pressurizing chamber body 10*a*.

<Second Embodiment>

With reference to FIGS. 10(*a*) and 10(*b*), a liquid discharge head 102 according to a second embodiment will now be described herein. The liquid discharge head 102 includes a discharge unit 115 and other components. The discharge unit 115 differs in configuration from the discharge unit of the liquid discharge head 2, but the other components are identical in configuration to the other components of the liquid discharge head 2. Therefore, a detailed description of the configuration is omitted. Moreover, identical members are applied hereinafter with identical reference characters. Moreover, similar to FIG. 9, an actual flow of liquid is rendered with a solid line, while a flow of the liquid supplied from a third individual flow passage 116 is rendered with a broken line.

The discharge unit 115 includes the discharge hole 8, the pressurizing chamber 10, the first individual flow passage (first flow passage) 12, a second individual flow passage (second flow passage) 114, and the third individual flow passage (third flow passage) 116. The first individual flow passage 12 and the third individual flow passage 116 are connected to the first common flow passage 20 (fifth flow passage), and the second individual flow passage 114 is connected to the second common flow passage 24 (fourth flow passage). Therefore, in the discharge unit 115, liquid is supplied from the first individual flow passage 12 and the third individual flow passage 116, and is collected from the second individual flow passage 114.

In the liquid discharge head 102, when viewed in a plane, the first individual flow passage 12 is connected, on a side facing the first direction D1, to the pressurizing chamber body 10*a*, the second individual flow passage 114 is connected, on a side facing the fourth direction D4, to the partial flow passage 10*b*, and the third individual flow passage 116 is connected, on a side facing the first direction D1, to the partial flow passage 10*b*.

Therefore, when viewed in a plane, in the discharge unit 115, the liquid is supplied from the first direction D1, and is collected from the fourth direction D4. Therefore, the liquid in the partial flow passage 10*b* can effectively flow from the first direction D1 to the fourth direction D4, thus a region in which the liquid stagnates is prevented as much as possible from being created in the partial flow passage 10*b*.

That is, since the third individual flow passage 116 is connected to the partial flow passage 10*b* positioned lower than the pressurizing chamber body 10*a*, the liquid flows, as shown with a broken line, around the region 80. As a result, the liquid can flow into the region 80 positioned opposite to a portion connected with the second individual flow passage 114. Thus, a region in which the liquid stagnates is prevented as much as possible from being created in the partial flow passage 10*b*.

<Third Embodiment>

Figure 11A:
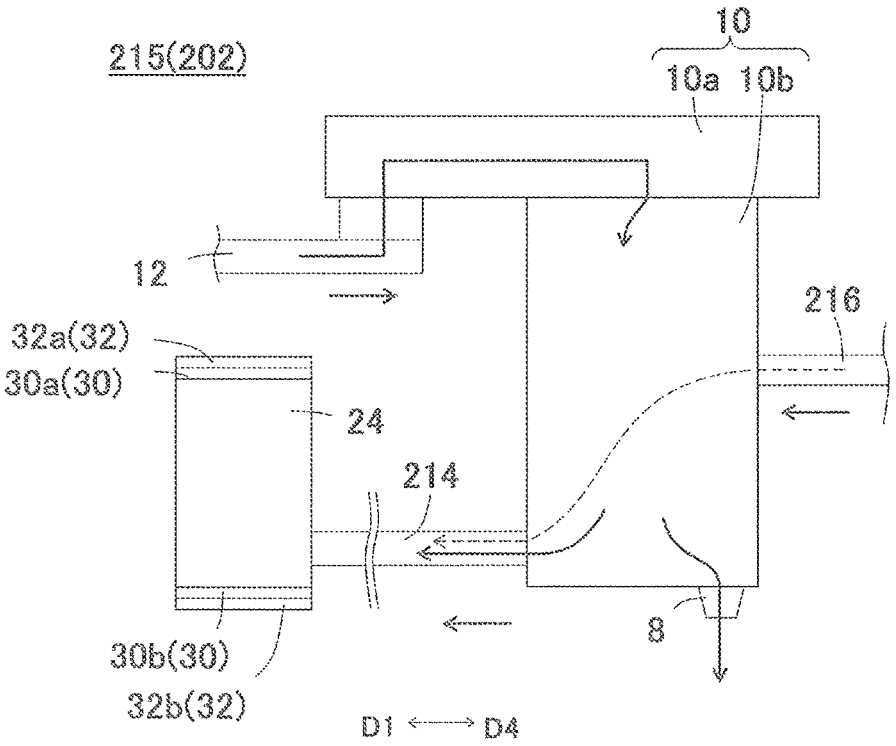
FIGS. 11(*a*) and 11(*b*) illustrates a liquid discharge head according to a third embodiment, where FIG. 11(*a*) is a schematic view illustrating a flow of a fluid in a liquid discharge unit, and FIG. 11(*b*) is a plan view of the discharge unit.
Figure 11B:
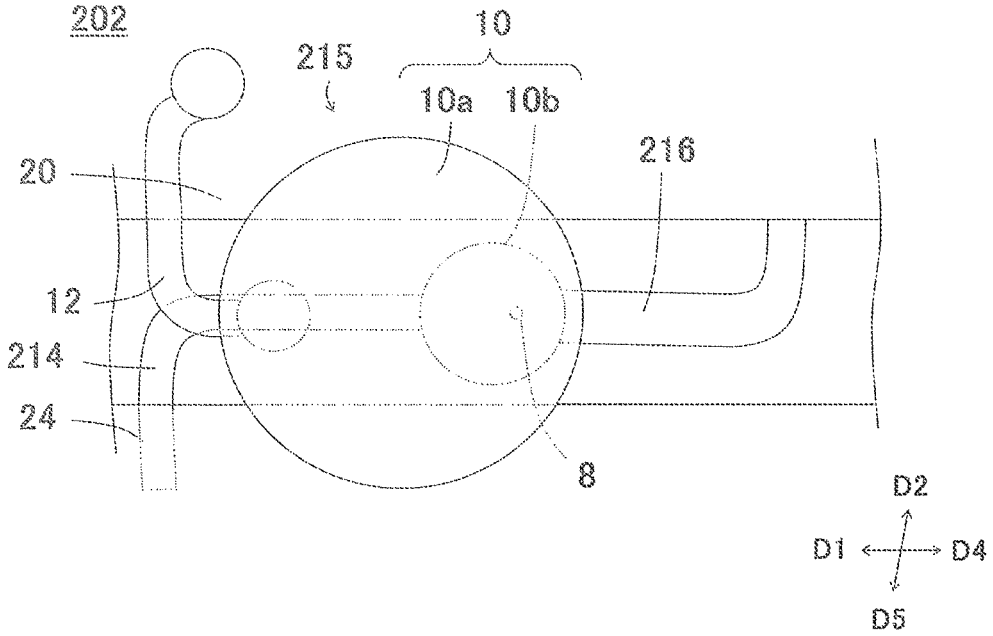

With reference to FIGS. 11(*a*) and 11(*b*), a liquid discharge head 202 according to a third embodiment will now be described herein.

A discharge unit 215 includes the discharge hole 8, the pressurizing chamber 10, the first individual flow passage (first flow passage) 12, a second individual flow passage (second flow passage) 214, and a third individual flow passage (third flow passage) 216. The first individual flow passage 12 and the third individual flow passage 216 are connected to the first common flow passage 20 (fifth flow passage), and the second individual flow passage 214 is connected to the second common flow passage 24 (fourth flow passage). Therefore, in the discharge unit 215, liquid is supplied from the first individual flow passage 12 and the third individual flow passage 216, and is collected from the second individual flow passage 214.

In the liquid discharge head 202, when viewed in a plane, the first individual flow passage 12 is connected, on a side facing the first direction D1, to the pressurizing chamber body 10*a*, and the third individual flow passage 216 is connected, on a side facing the fourth direction D4, to the partial flow passage 10*b*.

Therefore, when viewed in a plane, the separate unit 215 is supplied with the liquid from both the first direction D1 and the fourth direction D4. Therefore, the supplied liquid can have a velocity component of the first direction D1 and a velocity component of the fourth direction D4. Therefore, the liquid supplied into the pressurizing chamber 10 agitates the liquid in the partial flow passage 10*b*. As a result, a region in which the liquid stagnates is further prevented as much as possible from being created in the partial flow passage 10*b*.

In addition, the second individual flow passage 214 is connected, on a side facing the first direction D1, to the partial flow passage 10*b*, and the third individual flow passage 216 is connected, on the side facing the fourth direction D4, to the partial flow passage 10*b*. Therefore, the liquid supplied from the third individual flow passage 216 flows across the partial flow passage 10*b*, from the fourth direction D4 to the first direction D1. As a result, a region in which the liquid stagnates is prevented as much as possible from being created in the partial flow passage 10*b*.

In addition, the discharge hole 8 is connected at a lower end of the partial flow passage 10*b*, and the second individual flow passage 214 is connected at a position higher than the lower end of the partial flow passage 10*b*. As a result, even if a pressure wave generated in the second common flow passage 24 propagates, via the second individual flow passage 214, into the partial flow passage 10*b*, a distance between the second individual flow passage 214 and the discharge hole 8 prevents as much as possible the pressure wave from being propagated into the discharge hole 8. Therefore, a configuration can be achieved in which a pressure wave generated in the second common flow passage 24 is difficult to propagate, via the second individual flow passage 214, into discharge hole 8.

Moreover, the lower end of the partial flow passage 10*b* is referred to as a portion, in the partial flow passage 10*b*, connected to the discharge hole 8 and formed on the plate 4*l* adjacent to the plate 4*m* formed with the discharge hole 8.

<Fourth Embodiment>

Figure 12A:
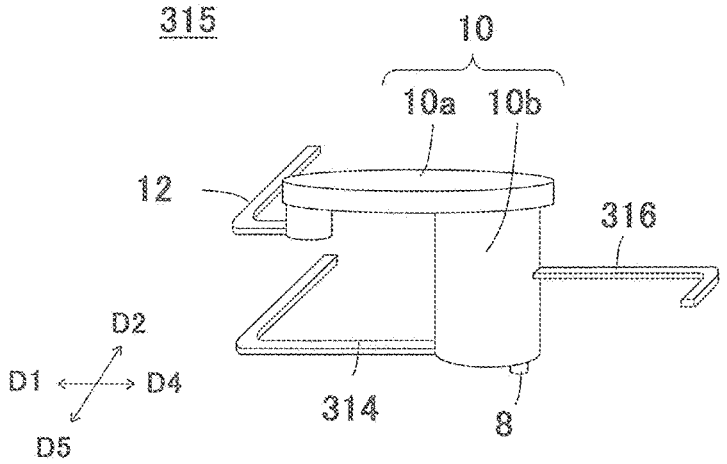
FIG. 12(*a*) is a perspective view of a liquid discharge unit configuring a liquid discharge head according to a fourth embodiment, and FIG. 12(*b*) is a cross-sectional view of the liquid discharge unit configuring the liquid discharge head according to the fourth embodiment.
Figure 12B:
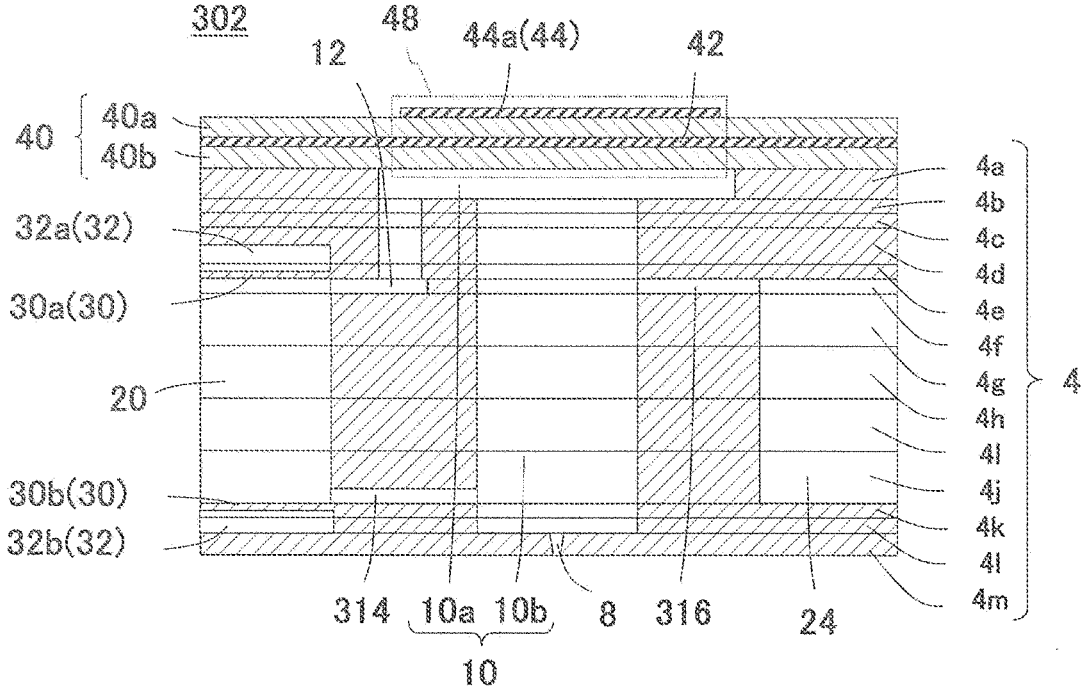
Figure 13:
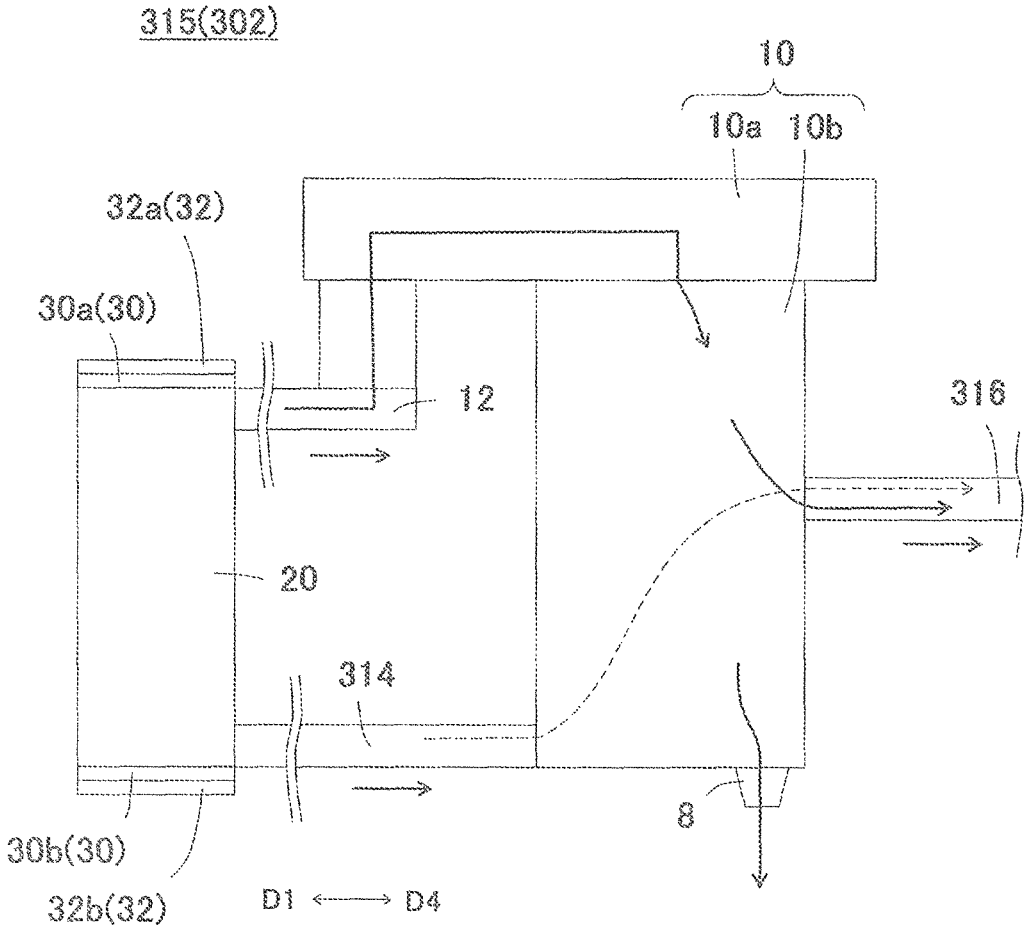
FIG. 13 is a schematic view illustrating a flow of a fluid in the liquid discharge unit configuring the liquid discharge head according to the fourth embodiment.

With reference to FIGS. 12(*a*), 12(*b*) and 13, a liquid discharge head 302 according to a fourth embodiment will now be described herein. The liquid discharge head 302 includes a discharge unit 315 that differs from the discharge unit of the liquid discharge head 2. Moreover, in FIG. 13, an actual flow of liquid is rendered with a solid line, while a flow of the liquid supplied from a second individual flow passage 314 is rendered with a broken line.

The discharge unit 315 includes the discharge hole 8, the pressurizing chamber 10, the first individual flow passage (first flow passage) 12, the second individual flow passage (third flow passage) 314, and a third individual flow passage (second flow passage) 316. The first individual flow passage 12 and the second individual flow passage 314 are connected to the first common flow passage 20 (fifth flow passage), and the third individual flow passage 316 is connected to the second common flow passage 24 (fourth flow passage). Therefore, in the discharge unit 315, liquid is supplied from the first individual flow passage 12 and the second individual flow passage 314, and is collected from the third individual flow passage 316.

The first individual flow passage 12 extends downwardly from the pressurizing chamber body 10*a*, extends in the first direction D1, extends in the second direction D2, and is connected to a side surface of the first common flow passage 20. The second individual flow passage 314 extends from the partial flow passage 10*b* in the first direction D1, extends in the second direction D2, and is connected to the side surface of the first common flow passage 20. The third individual flow passage 316 extends from the partial flow passage 10*b* in the fourth direction D4, extends in the fifth direction D5, and is connected to a side surface of the second common flow passage 24.

In the liquid discharge head 302, when viewed in a plane, the first individual flow passage 12 is connected, on a side facing the first direction D1, to the pressurizing chamber body 10*a*, the second individual flow passage 314 is connected, on a side facing the first direction D1, to the partial flow passage 10*b*, and the third individual flow passage 316 is connected, on a side facing the fourth direction D4, to the partial flow passage 10*b*.

Therefore, when viewed in a plane, in the discharge unit 315, the liquid is supplied from the first direction D1, and is collected from the fourth direction D4. Therefore, the liquid in the partial flow passage 10*b* can effectively flow from the first direction D1 to the fourth direction D4, thus a region in which the liquid stagnates is prevented as much as possible from being created in the partial flow passage 10*b*.

<Fifth Embodiment>

Figure 14:
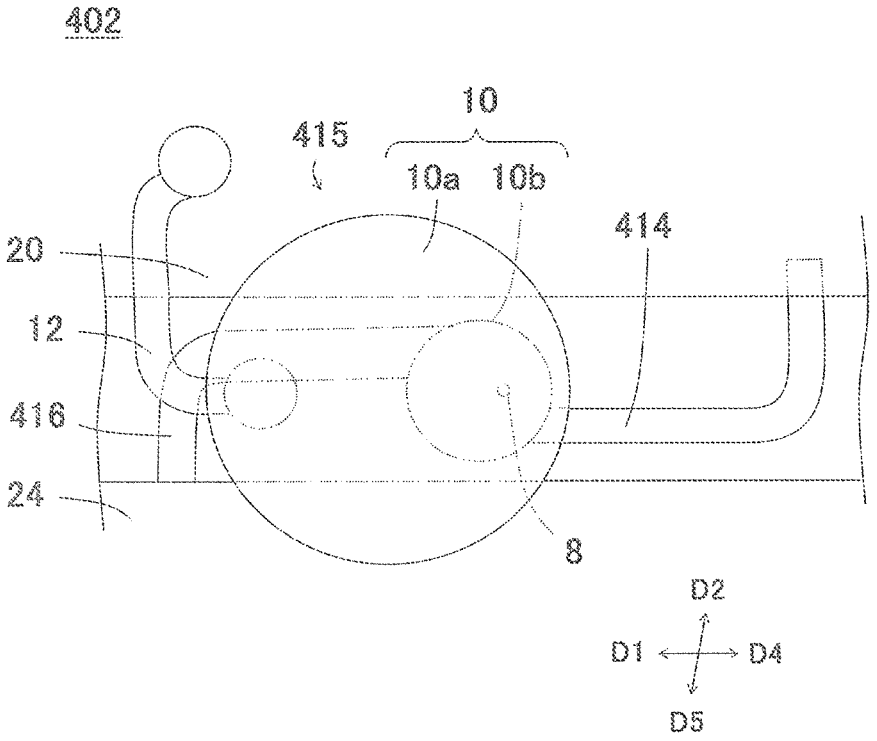
FIG. 14 is a plan view of a discharge unit configuring a liquid discharge head according to a fifth embodiment.

With reference to FIG. 14, a liquid discharge head 402 according to a fifth embodiment will now be described herein. The liquid discharge head 402 includes a discharge unit 415 that differs from the discharge unit of the liquid discharge head 2.

The discharge unit 415 includes the discharge hole 8, the pressurizing chamber 10, the first individual flow passage (first flow passage) 12, a second individual flow passage (third flow passage) 414, and a third individual flow passage (second flow passage) 416. The first individual flow passage 12 and the second individual flow passage 414 are connected to the first common flow passage 20 (fifth flow passage), and the third individual flow passage 416 is connected to the second common flow passage 24 (fourth flow passage). Therefore, in the discharge unit 415, liquid is supplied from the first individual flow passage 12 and the second individual flow passage 414, and is collected from the third individual flow passage 416.

The second individual flow passage 414 is connected to a side surface of the partial flow passage 10*b*, extends from the side surface of the partial flow passage 10*b* in the fourth direction D4, extends in the second direction D2, and connected to a side surface of the first common flow passage 20. The second individual flow passage 414 is, on the side surface of the partial flow passage 10*b*, when viewed in a plane, connected offset toward the fifth direction D5 from a center of the partial flow passage 10*b*.

The third individual flow passage 416 is connected to the side surface of the partial flow passage 10*b*, extends from the side surface of the partial flow passage 10*b* in the first direction D1, extends in the fifth direction D5, and connected to a side surface of the second common flow passage 24. The third individual flow passage 416 is, on the side surface of the partial flow passage 10*b*, when viewed in a plane, connected offset toward the second direction D2 from the center of the partial flow passage 10*b*.

Therefore, the discharge unit 415 has, when viewed in a plane, a configuration where the second individual flow passage 414 and the third individual flow passage 416 connected to the side surface of the partial flow passage 10*b* do not extend in an identical straight line. In other words, the second individual flow passage 414 and the third individual flow passage 416 extend, in different straight lines, from the side surface of the partial flow passage 10*b* in opposite directions each other.

Therefore, the liquid flowing from the first direction D1 and the liquid flowing from the fourth direction D4 cause, when viewed in a plane, the liquid to flow clockwise inside the partial flow passage 10*b*. As a result, the liquid present in the discharge hole 8 can be agitated, thus a surface of the discharge hole 8 is kept almost always wet.

Moreover, the second individual flow passage 414 may be, on the side surface of the partial flow passage 10*b*, when viewed in a plane, connected closer to the second direction D2 than the center of the partial flow passage 10*b*, and the third individual flow passage 416 may be, on the side surface of the partial flow passage 10*b*, when viewed in a plane, connected closer to the fifth direction D5 than the center of the partial flow passage 10*b*. Also in such a case, a similar effect can be obtained.

Although the first to fifth embodiments have been described above, the present invention should not be limited to the above described embodiments, but may be variously changed without departing from the scope of the present invention.

For example, as the pressurizing section, the pressurizing chamber 10 is pressurized through a piezoelectric deformation of a piezoelectric actuator, but the pressurizing section is not limited to this example. For example, a pressurizing section may provide a heating section per each of the pressurizing chambers 10 to heat liquid in the pressurizing chambers 10 with the heating sections to pressurize the liquid through thermal expansion.

In addition, a configuration may be applied, where liquid is supplied from the second individual flow passages 14 and the third individual flow passages 16 to the pressurizing chambers 10, and collected from the first individual flow passages 12. In this case, the first flow passage is the first individual flow passage 12, the second flow passage is the second individual flow passage 14, and the third flow passage is the third individual flow passage 16.

That is, the liquid discharge head 2 may be configured in that liquid is supplied from the second individual flow passages 14 to the partial flow passages 10*b*, so that the supplied liquid flows upwardly into the partial flow passages 10*b*, and is supplied to the pressurizing chamber bodies 10*a*, and then the liquid supplied to the pressurizing chamber bodies 10*a* is collected from the first individual flow passages 12. And then the third individual flow passages 16 may be configured to respectively be connected to the partial flow passages 10*b* so as to supply liquid to the partial flow passages 10*b*.

Also in this case, the liquid flowing from the second individual flow passages 14 to the pressurizing chambers 10 for supply and the liquid flowing from the third individual flow passages 16 for supply can collide. Therefore, the liquid shared from the discharge holes 8 to the pressurizing chambers 10 is prevented as much as possible from evenly and approximately linearly flowing, thus a region in which the liquid stagnates is prevented as much as possible from being created in the pressurizing chambers 10.

Moreover, in a case described above, since the liquid flows into the liquid discharge head 2 in an opposite direction in the first flow passage member 4, the second common flow passages 24 supply the liquid to the discharge units 15, and the first common flow passages 20 collect the liquid from the discharge units 15. In addition, in the second flow passage member 6, the second integrated flow passage 26 supplies the liquid to the second common flow passages 24, and the first integrated flow passage 22 collects the liquid from the first common flow passages 20.

DESCRIPTION OF THE REFERENCE NUMERAL

1: Color inkjet printer
2,102,202,302,402: Liquid discharge head
2*a*: Head body
4: First flow passage member
4*a*~4*m*: Plate(s)
4-1: Pressurizing chamber surface
4-2: Discharge hole surface
6: Second flow passage member
8: Discharge hole
10: Pressurizing chamber
10*a*: Pressurizing chamber body
10*b*: Partial flow passage
12: First individual flow passage (first flow passage)
14,114,214,314,414: Second individual flow passage (second flow passage)
15,115,215,315,415: Discharge unit
16,116,216,316,416: Third individual flow passage (third flow passage)
20: First common flow passage (fifth flow passage)
22: First integrated flow passage
24: Second common flow passage (fourth flow passage)
26: Second integrated flow passage
28: Edge flow passage
30: Damper
32: Damper chamber
40: Piezoelectric actuator substrate
48: Displacement element (pressurizing section)
50: Housing

52: Heat sink
54: Circuit board
56: Press member
58: Elastic member
60: Signal transmission section
62: Driver IC
70: Head mounting frame
72: Head group
74*a*,74*b*,74*c*,74*d*: Conveying rollers
76: Control section
P: Recording medium
D1: First direction
D2: Second direction
D3: Third direction
D4: Fourth direction
D5: Fifth direction
D6: Sixth direction

The invention claimed is:

1. A liquid discharge head comprising:
a flow passage member comprising:
a plurality of discharge holes;
a plurality of pressurizing chambers respectively connected to the plurality of discharge holes;
a plurality of first flow passages respectively connected to the plurality of pressurizing chambers to supply liquid to the plurality of pressurizing chambers;
a plurality of second flow passages respectively connected to the plurality of pressurizing chambers to collect the liquid from the plurality of pressurizing chambers;
a plurality of third flow passages respectively connected to the plurality of pressurizing chambers to supply the liquid to the plurality of pressurizing chambers; and
a plurality of pressurizing sections respectively pressurizing the plurality of pressurizing chambers,
wherein the pressurizing chamber comprises a pressurizing chamber body, and a partial flow passage connecting the pressurizing chamber body and the discharge hole, the pressurizing chamber body being connected with the first flow passage, the partial flow passage being connected with the third flow passage.

2. The liquid discharge head according to claim 1, wherein a lower end of the partial flow passage is connected to the discharge hole, and, when viewed in a cross section, the third flow passage is connected to a position higher than the lower end of the partial flow passage.

3. The liquid discharge head according to claim 1, wherein the second flow passage is connected to the partial flow passage.

4. The liquid discharge head according to claim 3, wherein the second flow passage is connected closer, than the third flow passage, to the pressurizing chamber body.

5. The liquid discharge head according to claim 3, wherein the second flow passage is connected closer, than the third flow passage, to the discharge hole.

6. The liquid discharge head according to claim 1, wherein the flow passage member comprises, when viewed in a plane, a first direction, and a second direction opposite to the first direction, the first flow passage is connected, on a side facing the first direction, to the pressurizing chamber body, and the third flow passage is connected, on a side facing the second direction, to the partial flow passage.

7. The liquid discharge head according to claim 1, wherein the flow passage member comprises, when viewed in a plane, a first direction, and a second direction opposite to the first direction, the first flow passage is connected, on a side facing the first direction, to the pressurizing chamber body, the second flow passage is connected, on a side facing the second direction, to the partial flow passage, and the third flow passage is connected, on a side facing the first direction, to the partial flow passage.

8. The liquid discharge head according to claim 1, wherein the flow passage member further comprises a fourth flow passage connected in common to the plurality of second flow passages, the fourth flow passage being connected, on a side facing the pressurizing chamber body, with the second flow passage.

9. The liquid discharge head according to claim 1, wherein the flow passage member comprises, when viewed in a plane, a first direction, and a second direction opposite to the first direction, the first flow passage is connected, on a side facing the first direction, to the pressurizing chamber body, and an area center of gravity of the partial flow passage is positioned at a position closer, than an area center of gravity of the pressurizing chamber body, to the second direction.

10. The liquid discharge head according to claim 1, wherein, when viewed in a plane, the discharge hole is disposed between the second flow passage and the third flow passage.

11. The liquid discharge head according to claim 1 the pressurizing section is provided, when viewed in a cross section, on the pressurizing chamber, the third flow passage is disposed lower than the first flow passage, and a flow passage resistance in the third flow passage is lower than a flow passage resistance in the first flow passage.

12. The liquid discharge head according to claim 11, wherein, when viewed in a cross section, the second flow passage is disposed at a position higher than the third flow passage and lower than the first flow passage.

13. The liquid discharge head according to claim 1, wherein, when viewed in a cross section, the third flow passage is provided closer, than the first flow passage, to the discharge hole, and a flow passage resistance in the third flow passage is lower than a flow passage resistance in the first flow passage.

14. A recording device comprising:
the liquid discharge head according to claim 1;
a conveyor for conveying a recording medium toward the liquid discharge head; and
a control section for controlling the liquid discharge head.

15. The liquid discharge head according to claim 1, wherein the flow passage member further comprises a fifth flow passage connected in common to the first flow passage and the third flow passage.

16. A liquid discharge head comprising:
a flow passage member comprising:
plurality of discharge holes;
a plurality of pressurizing chambers respectively connected to the plurality of discharge holes;
a plurality of first flow passages respectively connected to the plurality of pressurizing chambers;
a plurality of second flow passages respectively connected to the plurality of pressurizing chambers; and
a plurality of third flow passages respectively connected to the plurality of pressurizing chambers; and
a plurality of pressurizing sections respectively pressurizing the plurality of pressurizing chambers,
wherein, when viewed in a cross section, the plurality of pressurizing sections are provided respectively on the plurality of pressurizing chambers, the plurality of third flow passages are disposed lower than the plurality of first flow passages, and a flow passage resistance in an each third flow passage of the plurality of third flow passages is lower than a flow passage resistance in an each first flow passage of the plurality of first flow passages.

17. The liquid discharge head according to claim 16, wherein, when viewed in a cross section, the plurality of second flow passages are provided at positions lower than the plurality of first flow passages and higher than the plurality of third flow passages.

18. A recording device comprising:

the liquid discharge head according to claim 16;

a conveyor for conveying a recording medium toward the liquid discharge head; and a control section for controlling the liquid discharge head.

19. A liquid discharge head comprising:

a flow passage member comprising:

a discharge hole;

a pressurizing chamber connected to the discharge hole;

a first flow passage connected to the pressurizing chamber to supply liquid to the pressurizing chamber;

a second flow passage connected to the pressurizing chamber to collect the liquid from the pressurizing chamber;

a third flow passage connected to the pressurizing chamber to supply the liquid to the pressurizing chamber; and a fifth flow passage connected to the first flow passage and the third flow passage; and a pressurizing section pressurizing the pressurizing chamber, wherein, when viewed in a cross section, the third flow passage is disposed lower than the first flow passage.

20. A recording device comprising:

the liquid discharge head according to claim 19;

a conveyor for conveying a recording medium toward the liquid discharge head; and a control section for controlling the liquid discharge head.

* * * * *